US011045715B2

(12) United States Patent
Hall et al.

(10) Patent No.: US 11,045,715 B2
(45) Date of Patent: Jun. 29, 2021

(54) ENTERTAINMENT SYSTEM FOR CASINO WAGERING USING PHYSICAL RANDOM NUMBER GENERATORS

(71) Applicant: Bally Gaming, Inc., Las Vegas, NV (US)

(72) Inventors: Geoff Hall, Solihull (GB); Roger M. Snow, Las Vegas, NV (US)

(73) Assignee: SG Gaming, Inc., Las Vegas, NV (US)

( * ) Notice: Subject to any disclaimer, the term of this patent is extended or adjusted under 35 U.S.C. 154(b) by 0 days.

(21) Appl. No.: 16/672,311

(22) Filed: Nov. 1, 2019

(65) Prior Publication Data

US 2020/0155922 A1 May 21, 2020

Related U.S. Application Data

(60) Provisional application No. 62/770,733, filed on Nov. 21, 2018.

(51) Int. Cl.
*A63F 1/00* (2006.01)
*A63F 1/04* (2006.01)
(Continued)

(52) U.S. Cl.
CPC ..... *A63F 1/04* (2013.01); *A63F 1/067* (2013.01); *A63F 1/12* (2013.01); *A63F 1/00* (2013.01); *A63F 9/04* (2013.01); *A63F 2001/003* (2013.01); *A63F 2009/0473* (2013.01); *A63F 2009/0475* (2013.01); *A63F 2009/0484* (2013.01); *G07F 17/3211* (2013.01); *G07F 17/3293* (2013.01)

(58) Field of Classification Search
CPC ..... A63F 2001/003; A63F 2001/005; A63F 2009/0473; A63F 2009/0475; A63F 2009/0484; A63F 9/04
USPC ..... 273/146, 292, 138.1, 274
See application file for complete search history.

(56) References Cited

U.S. PATENT DOCUMENTS 5,842,698 A * 12/1998 Brown ..... A63F 3/00157 273/292
6,588,750 B1 7/2003 Grauzer et al.
(Continued)

OTHER PUBLICATIONS

U.S. Appl. No. 13/353,194, filed Jan. 18, 2012.
(Continued)

*Primary Examiner* — Benjamin Layno

(57) ABSTRACT

Examples are disclosed for a method and apparatus for administering a blackjack game. In some instances, administering the blackjack game comprises receiving at least one wager in a designated player wager area on a gaming surface associated with the blackjack game. In some instances, the at least one wager is associated with at least one tangible gaming chip. Furthermore, in some instances, the blackjack game is associated with a physical gaming table with a play surface and at least one deck of physical card. In some instances, administering the blackjack game comprises dealing, after receiving the at least one wager, at least one hand from the at least one deck for the blackjack game; determining that an outcome of the hand necessitates a dice roll of a set of specialized physical dice associated with a secondary game; determining a payout value on the at least one wager based on an outcome of the dice roll; and resolving the at least one wager according to the payout value.

19 Claims, 14 Drawing Sheets

(51) Int. Cl.

| | |
|---|---|
| ***A63F 1/12*** | (2006.01) |
| ***A63F 1/06*** | (2006.01) |
| *G07F 17/32* | (2006.01) |
| *A63F 9/04* | (2006.01) |

(56) References Cited

U.S. PATENT DOCUMENTS

| | | | | |
|---|---|---|---|---|
| 6,612,927 | B1 | 9/2003 | Slomiany et al. | |
| 7,435,172 | B2 | 10/2008 | Hall | |
| 7,637,807 | B2 | 12/2009 | Asher et al. | |
| 7,677,565 | B2 | 3/2010 | Grauzer et al. | |
| 7,758,411 | B2 | 7/2010 | Crawford, III et al. | |
| 7,775,887 | B2 | 8/2010 | Kuhn et al. | |
| 7,901,285 | B2 | 3/2011 | Tran et al. | |
| 7,934,980 | B2 | 5/2011 | Blaha et al. | |
| 8,262,475 | B2 | 9/2012 | Snow et al. | |
| 8,272,958 | B2 | 9/2012 | Smith et al. | |
| 8,292,714 | B2 | 10/2012 | Kennedy | |
| 8,474,822 | B2 | 7/2013 | Chen et al. | |
| 8,511,684 | B2 | 8/2013 | Grauzer et al. | |
| 8,579,289 | B2 | 11/2013 | Rynda et al. | |
| 2003/0155715 | A1 | 8/2003 | Walker et al. | |
| 2004/0000755 | A1 | 1/2004 | Cherven | |
| 2010/0038849 | A1 | 2/2010 | Scheper et al. | |
| 2016/0296832 | A1* | 10/2016 | Newton | A63F 1/00 |
| 2018/0243642 | A1 | 8/2018 | Krenn et al. | |

OTHER PUBLICATIONS

U.S. Appl. No. 13/609,031, filed Sep. 10, 2012.
U.S. Appl. No. 13/919,849, filed Jun. 17, 2013.
U.S. Appl. No. 13/963,165, filed Aug. 9, 2013.
U.S. Appl. No. 62/770,733.

* cited by examiner

MAIN BET HERE
(BLACKJACK PAYS OUT 3:2)

MANDATORY LIGHTNING
BET HERE

IF YOUR INITIAL 2-CARD DEAL IS A BLACKJACK,
ROLL THE 3 LIGHTNING DICE AND COLLECT A PAYOUT ON
THE LIGHTNING BET AS FOLLOWS:

620

LIGHTNING BLACKJACK

| DICE OUTCOME | PAYS |
|---|---|
| 0 BOLTS | 9 TO 1 |
| 1 BOLT | 10 TO 1 |
| 2 MIXED COLOR BOLTS | 20 TO 1 |
| 2 SAME COLOR BOLTS | 40 TO 1 |
| 3 MIXED COLOR BOLTS | 100 TO 1 |
| 3 SAME COLOR BOLTS | 200 TO 1 |

600

ENTERTAINMENT SYSTEM FOR CASINO WAGERING USING PHYSICAL RANDOM NUMBER GENERATORS

RELATED APPLICATIONS

This application claims the priority benefit of U.S. Provisional Application Ser. No. 62/770,733 filed Nov. 21, 2018.

BACKGROUND

Field

The present general inventive concept is directed to a method, apparatus, and computer readable storage medium directed to a wagering game. The wagering game can be played physically in a physical casino or electronically.

Description of the Related Art

Casino table games using cards (both played in live format and electronic format) are a billion dollar industry. The industry is also striving to produce new and exciting wagering methods which players may find fresh and exciting and the house (casino) finds profitable.

FIG. 1 is a flowchart illustrating a method of implementing the known game of blackjack.

Points totals are computed by adding the standard rank value of each card, with face valued cards (tens, jacks, queens, kings) being given a value of 10, and aces being given a value of 1 or 11, whichever results in a better hand. A soft point total is where at least one ace is given the value of 11. A hard point total is a hand with all aces counting as 1.

In operation 100, the player makes and the dealer receives a main wager by placing chips on a table. Then, in operation 102, the dealer deals two initial cards (or "initial two cards") to each player card area (either face up or face down although the player would always have the opportunity to view his/her own face down initial two cards) and two initial cards to the dealer card area, typically one face down ("hole-card"), and one face up (the "up-card"). Then the player can decide whether to hit, stand, double, or split. If the player decides to hit, then the method proceeds to operation 106, in which the dealer deals an additional card to a player card area. If a determination 108 determines that the player hand has busted (the player's hard point total is over 21), then the player loses the game and thus loses the main wager in operation 110, and the main wager is transferred to the house, which ends the game. If the determination 108 determines that the player hand has not busted, then the method returns to operation 104, where the player can make another decision whether to accept a hit card or stand. In operation 104, the player can also double down (not pictured) by placing an additional wager of up to the main wager in the player betting area on the layout, but the player is limited to receiving only one additional card in the player card area before the player must stand.

If the player stands and has not busted (either stands on his or her initial two cards or draws cards but has a point total under 22 and then stands), then the method proceeds to operation 112, in which the dealer reveals all dealer's cards (e.g., turns the hole-card face up) in the dealer card area on the layout and which then plays out the dealer's hand according to predetermined rules. In operation 114, if the dealer's hand total is greater than a predetermined amount (typically 17), then the dealer stands (proceeds to operation 122). If the dealer's hand total is not greater than the predetermined amount, the method proceeds to operation 116 in which the dealer deals an additional card to the dealer hand. If it is then determined 118 that the dealer hand has not busted (has a point total over 21), the method returns to operation 114. If the dealer hand has busted, then the player wins the game and the main wager in operation 120 (this assumes the player has not also busted; if the player has already busted then the player would have lost in operation 110 and would lose the main wager).

In operation 122, both the player and the dealer have played out their hand and neither have busted. Thus, their respective point totals (adding the numerical values of each card in the hand) are below 22 and are compared. If the dealer's point total is determined in operation 124 to be lower than the player's point total, then the player wins the game and the main wager is returned and a payout is made in operation 120. Otherwise, if the dealer's point total is determined 128 to be greater than the player's point total, then the player loses the game and the main wager in operation 130. If the player's point total ties the dealer's point total, then that results in a "push" in operation 126 in which the player wager is returned to the player.

If a player is initially dealt two identically ranked cards in operation 102 (e.g., two 2's, two 10-valued cards, etc.), the player can also split the cards into two separate hands in operation 104 by placing an additional split wager equal in value to the main wager, and the player's two initial cards are separated into different player card areas and the dealer deals an additional card into each area. The player then plays out each of the two separate hands, each from operation 104 as separate hands. Depending on house rules, players may or may not be allowed to resplit cards.

Furthermore, a 'push 22' rule is known in the art (see U.S. Pat. No. 7,435,172) which sets forth that when the dealer busts on a point total of 22 (or other total), the player's main wager would push (instead of winning as a standard game).

BRIEF SUMMARY

It is an aspect of the present invention to provide an exciting casino system.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DETAILED DESCRIPTION

Figure 1:
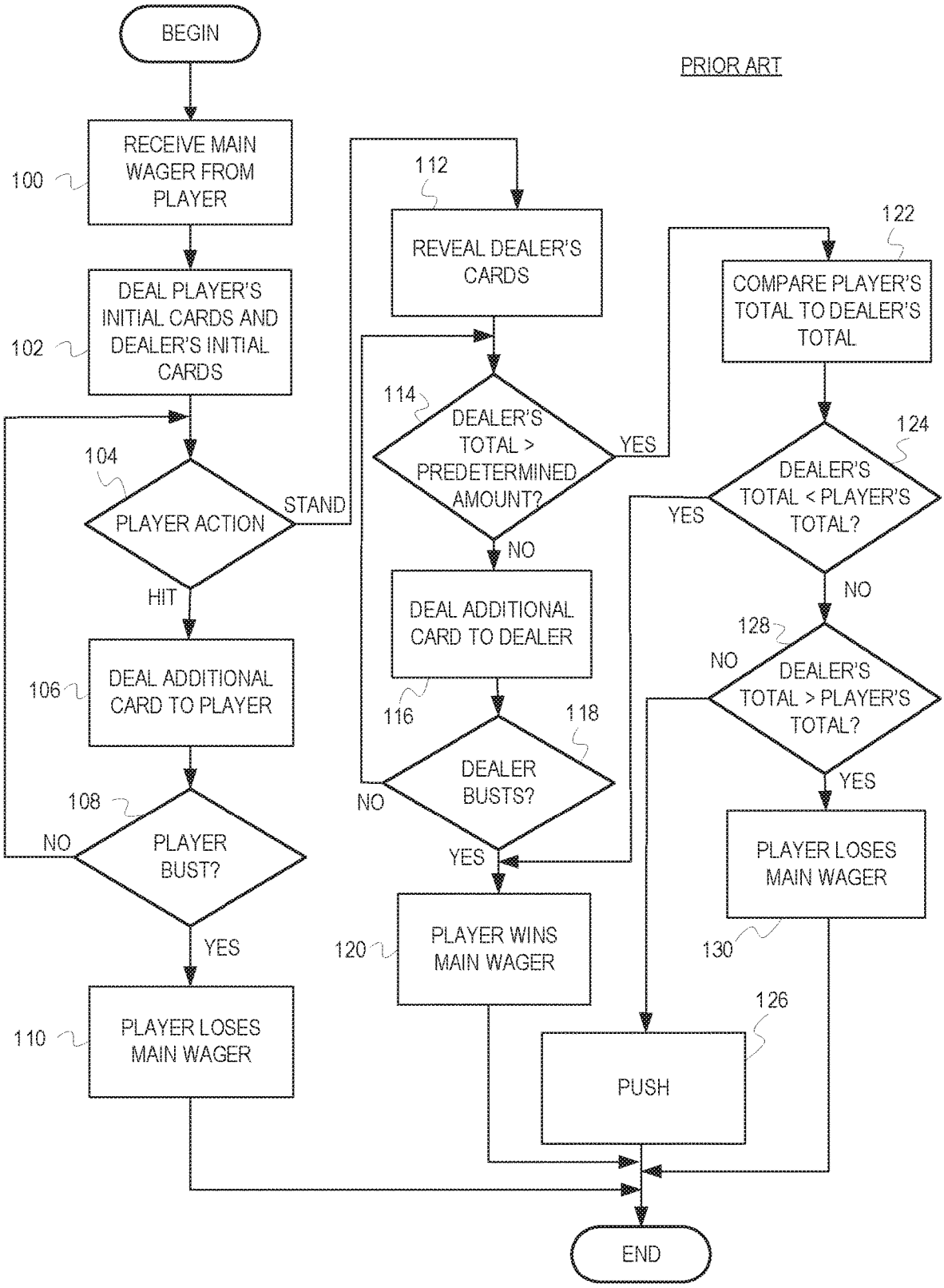
FIG. 1 is a flowchart illustrating a method of implementing a prior art blackjack game, according to an embodiment.

Reference will now be made in detail to various embodiments of the invention, examples of which are illustrated in the accompanying drawings, wherein like reference numerals refer to like elements throughout.

The game of blackjack is described in U.S. patent publication 2003/0155715 which is incorporated by reference herein in its entirety. The game can be played with any number (e.g., 1-8) of standard 52 card decks (either physical deck(s) played on a physical table in a brick and mortar casino, or virtual deck(s) used for an electronic version).

FIG. 1 is a flowchart illustrating a method of implementing a known game of blackjack.

In general, casino blackjack is played by one or more players at a gaming table against a dealer hand by using one or more decks of cards (each deck can be a standard 52 card deck). The idea is for the player to receive a hand having a point total closest to 21 without going over 21 (busting). Each player (after making a main wager) is dealt two initial cards (typically face up) and the dealer is also dealt two cards (one face up—the upcard, and one face down—the hole card). The player can stand on his or her initial two cards, or take one or more hit cards until the player stands or the player's point total is over 21 (upon which the player automatically loses). If the player hand has not busted, then after the player stands the dealer will play out the dealer's hand according to predetermined house rules. One set of dealer predetermined rules is as follows: the dealer will take hit cards sequentially until the dealer's point total is greater than 16. Once the dealer has resolved the dealer's hand, the wager is resolved. If the player has busted then the player automatically loses (the main wager). If the player has not busted but the dealer has busted (the dealer's point total is over 21) then the player wins (wins even money on the main wager). For example, the main wager is returned along with a payout amount equal to the main wager. If both the player and the dealer have not busted, the hand point counts are compared. If the player's point total is higher than the dealer's point total then the player wins (wins even money on the main wager). If both the player and the dealer have not busted, then if the dealer's point total is higher than the player's point total then the dealer wins (the player loses the main wager). If the player's point total equals the dealer's point total, then the main wager pushes (neither wins nor loses) and the main wager is returned to the player. Other options the player may have at his or her disposal is to double down or split pairs into two separate hands. Cards are given their standard numerical value (i.e., aces count as 1 or 11 (whichever makes the best hand), 2's-10's count as their respective face value, jacks, queens, and kings all count as 10).

The inventive concept relates to playing a variation of blackjack which utilizes a die or dice in the game (which serves as a random number generator) to determine payout amounts. The inventive concept may include a method, apparatus, and computer readable storage medium to implement a game which includes a blackjack game which can be dealt as a standard blackjack game (see FIG. 1). However, in some embodiments, if the dealer busts on a point total of 22 (or other point total), then instead of all of the non-busting players winning (as in standard blackjack), or all of the players pushing their main wager (as in the prior art "push 22" feature set forth in U.S. Pat. No. 7,435,172 which is incorporated by reference herein in its entirety), special dice are rolled (by a dealer or player) to determine the player's payout. The special dice can comprise exactly 4 (or other number) identical dice (each die with six sides with an equal probability of landing on each side). Each die out of the set of special dice (also referred to as "dice" herein) would have six sides (as any standard die) but one side has a special indicia (e.g., a cat or any other type of indicia such as a specific shape, symbol, color, shade, texture, number, etc.) while the other five sides of the same die are blank. Of course aside from a cat, any other image(s) can be used. The player's goal is to roll as many cats as possible (e.g., if there are four dice then the maximum payout would be when four cats are rolled). The payout is determined by a paytable which utilizes the number of cats rolled (e.g., see Table II). For example, one of the dice would have the following sides: blank (first side), blank (second side), blank (third side), blank (fourth side), blank (fifth side), cat (sixth side).

Note that the blackjack game can be played with any set of rules. For example, Table I illustrates one exemplary set of rules, although any other set of rules can be utilized as well.

TABLE I

| |
|---|
| Dealer peeks for Blackjack. |
| Dealer hits soft 17 (H17). |
| Split 3 times for up to 4 total hands. |
| Player may double down after splitting. |
| No surrender. |
| Split Aces may not be hit or doubled. |

Other rules that can be configured (by the house/casino) are as follows: blackjack can pay 3:2, 6:5, 2:1, or 1:1; a pair of initially dealt aces can resplit or the initially dealt aces cannot be resplit.

Figure 2:
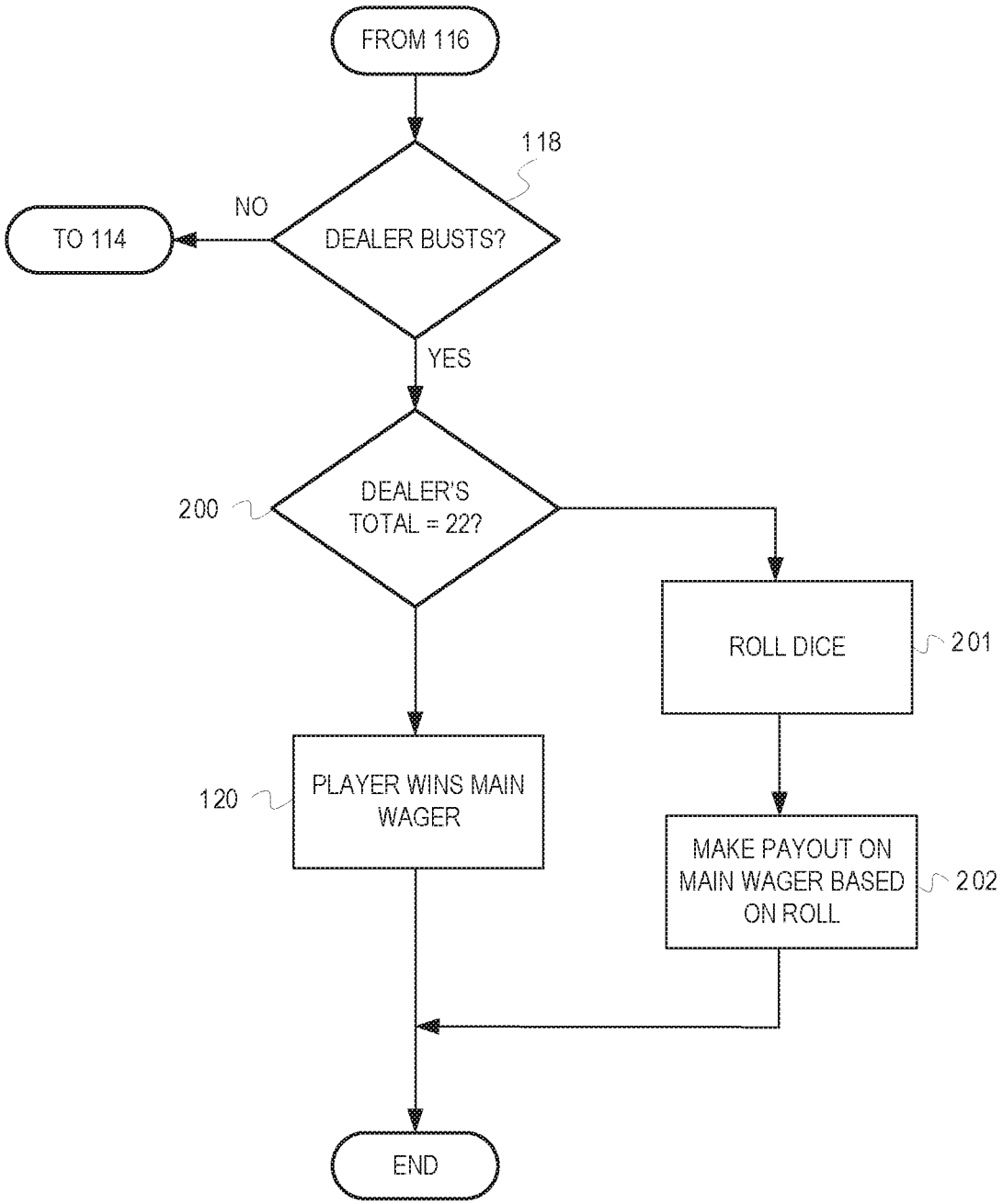
FIG. 2 is a flowchart illustrating a method of implementing a blackjack game with dice, according to an embodiment.

FIG. 2 is a flowchart illustrating a method of implementing a blackjack game with dice, according to an embodiment.

FIG. 2 modifies FIG. 1. FIG. 2 illustrates operation 118, which is from FIG. 1. If in operation 118, the dealer busts, then the method proceeds to operation 200.

In operation 200, it is determined whether the dealer's (busting) point total equals 22. Note that while 22 is a value that is used herein, this can be replaced with any other busting point total from 23 to 26, or a range of busting point totals, for example 22-26. If the dealer's point total is not 22, then the method proceeds to operation 120, wherein the player wins the main wager as described herein.

If in operation 200, the dealer's total equals 22, then the method proceeds to operation 201, wherein the special dice are rolled. In the example shown in FIG. 1, it was determined at determination 108 that the player hand had not busted. In some embodiments, before the special dice are rolled, the player hand is evaluated to determine if the hand value is 21 or below, indicating the player holds a winning hand. If the player hand is a winning hand, then at operation 201, the special dice are rolled. The dice can be rolled by the dealer, or one player at the table can be selected (e.g., at random by the dealer or other way) to roll the dice. For purposes of example, it is assumed there will be four such (identical) dice, although in other embodiments other numbers of dice can be used as well. Each die out of the dice are identical to each other and are fair (each of the six sides has an equal chance of being on top when the die is rolled). In other embodiments, a mechanical popper with a clear dome lid can be used to rotate the dice and reveal the top dice faces.

After the dice are rolled in operation 201, the method proceeds to operation 202, which makes a payout on the main wager based on the roll from operation 201. A paytable can be utilized to determine the payout. For example, Table II below represents two examples of such paytables.

TABLE II

| Number of cats | Paytable 1 | Paytable 2 |
|---|---|---|
| 4 | 100 to 1 | 50 to 1 |
| 3 | 10 to 1 | 10 to 1 |
| 2 | 3 to 1 | 2 to 1 |
| 1 | 1 to 1 | 1 to 1 |
| 0 | Push | Push |

For example, if the main wager (synonymous with "main bet") is $1, and the dealer busts on a point total of 22, then the dice (e.g., all four dice) are rolled and if 0 cats result (meaning all blanks are rolled) then the player's main wager pushes and the main wager is returned to the player. Using Paytable 1 from Table II, if one cat results (meaning three blanks are rolled), then the player is paid $1 (1 to 1 on the main wager amount which would be the same as a normal game where the player wins and the dealer busts with a hand count of 22). If two cat results (meaning two blanks are rolled), then the player would be paid $2 (2 times the main wager amount of $1), if three cat results (meaning one blanks are rolled), then the payout would be $10 (10 times the main wager amount of $10), and if four (all dice) cats result (meaning no blanks are rolled) then the payout would be $100 (100 times the main wager amount of $100). Note that when the dice are rolled, the player's main wager always remains on the table and is never taken from the player. Thus, when the dice are rolled, at the very worst the player will get a push on the overall blackjack hand, and at best the player could roll all four cats (out of four dice) and win 100 times the amount of the main wager (plus keeping the original main wager as well).

Any other numbers of dice can be used (with the paytable designed to reflect the number of dice used so that the casino/house always has a house edge). For instance, one embodiment includes a set of three, six-sided dice (instead of four dice). Four sides of each die are blank, one side has an image of a first type of indicia, and one side has an image of a second type of indicia (different from the first type in at least one way). For example, the first type of indicia may be a specific symbol of a first color (e.g., a gold colored cat symbol is printed on one side of the die), and the second type of indicia may be a specific symbol of a second color (e.g., a white colored cat symbol). In some embodiments, a payout on the main wager is based on an outcome corresponding to one or more paytables in Table III below.

TABLE III

| Dice Roll Outcome | Paytable 1 | Paytable 2 | Paytable 3 | Paytable 4 |
|---|---|---|---|---|
| 3 same color cats | 10 to 1 | 10 to 1 | 15 to 1 | 10 to 1 |
| 3 mixed color cats | 3 to 1 | 4 to 1 | 5 to 1 | 6 to 1 |
| 2 cats | 3 to 2 | 3 to 2 | 6 to 5 | 6 to 5 |
| 1 cat | 1 to 1 | 1 to 1 | 1 to 1 | 1 to 1 |
| 0 cats | Push | Push | Push | Push |

Figure 3:
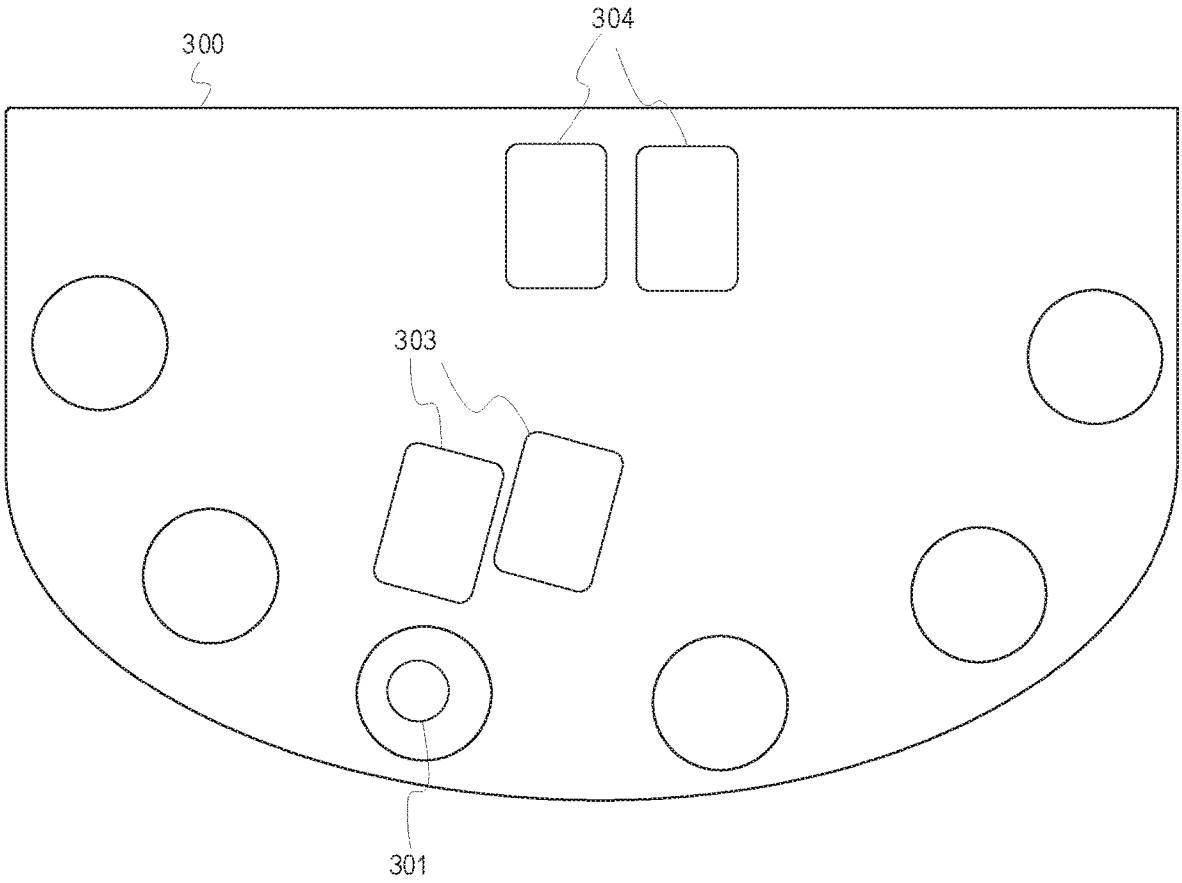
FIG. 3 is a drawing of a physical blackjack table for use in a casino, according to an embodiment.

FIG. 3 is a drawing of a physical blackjack table for use in a casino, according to an embodiment. This can be a physical table with physical cards and physical chips, or it can also be a virtual display on an electronic computer display which utilizes computer animation to display the progress of the game.

The table 300 has six betting circles which can accommodate six simultaneous players (although other numbers of players can be accommodated as well). A dealer's hand 304 and a player's hand 303 are dealt. A player makes a wager 301 in the form of chip(s).

Figure 4A:
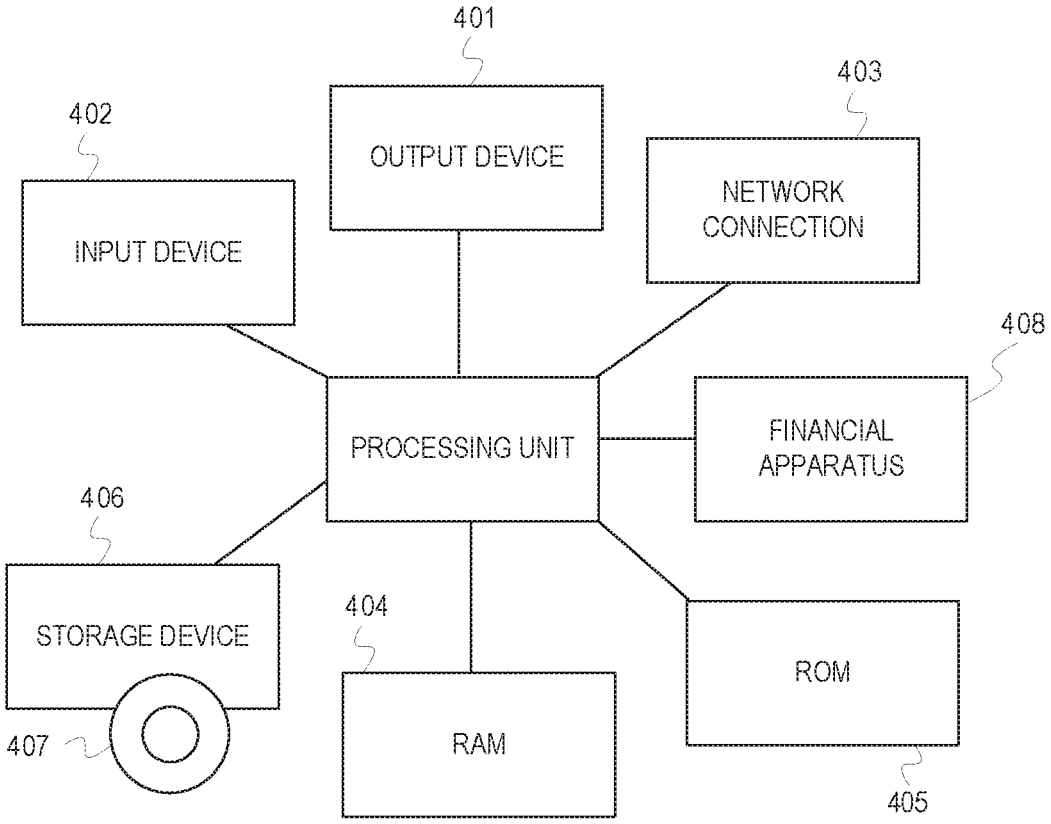
FIG. 4A is a block diagram illustrating exemplary hardware that can be used to implement an electronic version of the methods described herein.

FIG. 4A is a block diagram illustrating hardware that can be used to implement electronic versions of the wagering methods described herein, according to an embodiment. The hardware can be, for example, an electronic gaming machine (EGM) used in casinos. The hardware can also be a personal computer, playing the game using the Internet at an Internet casino for real money. The hardware can also be a digital multi-player casino table, for example the kind described in U.S. Pat. No. 7,775,887, which is incorporated by reference herein in its entirety. The hardware can also be any computing device, such as a cellular phone, tablet, etc., and the methods described herein can be installed as software (e.g., an app) on the device. The hardware can also be any other type of device, working individually or in conjunction with other devices. The hardware can also be a digital multi-player poker table, of the kind described in U.S. Pat. No. 7,758,411 which is incorporated by reference herein in its entirety.

A processing unit 400 (such as a microprocessor and any associated components) is connected to an output device 401 (such as an LCD monitor, touch screen, CRT, etc.) which is used to display to the player any aspect of the method, and an input device 402 (e.g., buttons, a touch screen, a keyboard, mouse, etc.) which can be used to input from the player any decision made by the player. All methods described herein can be performed by the processing unit 400 by loading and executing respective instructions. The processing unit 400 can also be connected to a network connection 403, which can connect the electronic gaming device to a computer communications network such as the Internet, a LAN, WAN, etc. The processing unit 400 is also connected to a RAM 404 and a ROM 405. The processing unit 400 is also connected to a storage device 406 which can be a DVD-drive, CD-ROM, flash memory, etc. Multiple such processing units can also work in collaboration with each other (in a same or different physical location). A non-transitory computer readable storage medium 407 can store a program which can control the electronic device to perform any of the methods described herein and can be read by the storage device 406. The processing unit 400 can also be connected to a financial apparatus 408 which can receive cash and convert the received cash into playable credits for use by the player when playing the electronic device. When the player decides to cash out any remaining credits, the financial apparatus 408 can issue coins or a cashless ticket (voucher) for the remaining credits which is redeemable by the player.

While one processing unit is shown, it can be appreciated that one or more such processors can work together (either in a same physical location or in different locations) to combine to implement any of the methods described herein. Programs and/or data required to implement any of the methods/features described herein can all be stored on any non-transitory computer readable storage medium (volatile or non-volatile, such as CD-ROM, RAM, ROM, EPROM, microprocessor cache, etc.)

Figure 4B:
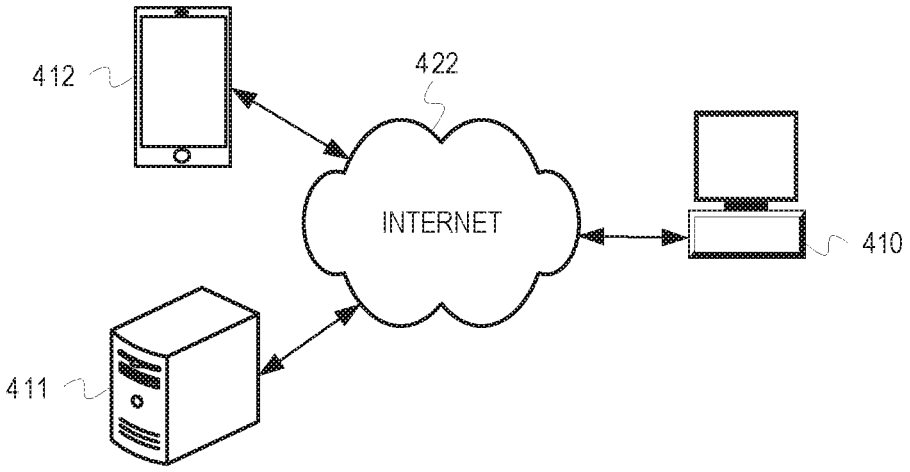
FIG. 4B is a block diagram illustrating an exemplary network configuration to implement a player playing an online version of the methods described herein.

FIG. 4B is a block diagram illustrating an exemplary network configuration to implement a player playing an online version of the methods described herein. All the methods described herein can be implemented on an online casino for real money (credits which are purchased for cash and are redeemable for cash) or for non-cash value credits. A player uses a personal computer 410 (e.g., cell phone, tablet, PC, etc.) can connect to a server 411 (which can have the structure illustrated in FIG. 4A) using a computer communications network such as the Internet. The server 411 hosts an online casino which determines the outcomes of the game and serves the outcomes to the computer 410 so the computer 410 displays the outcomes to the player. Other users can also play at the online casino hosted by the server 411 simultaneously, such as using a cell phone 412 with wireless internet connectivity. Any number of players (e.g., 1 to 100 or more than 100) can be connected to the internet 422 and can play simultaneously on the sever 411 even though these players are all located in different physical locations. The general structure of online casinos is well known in the art.

Figure 5:
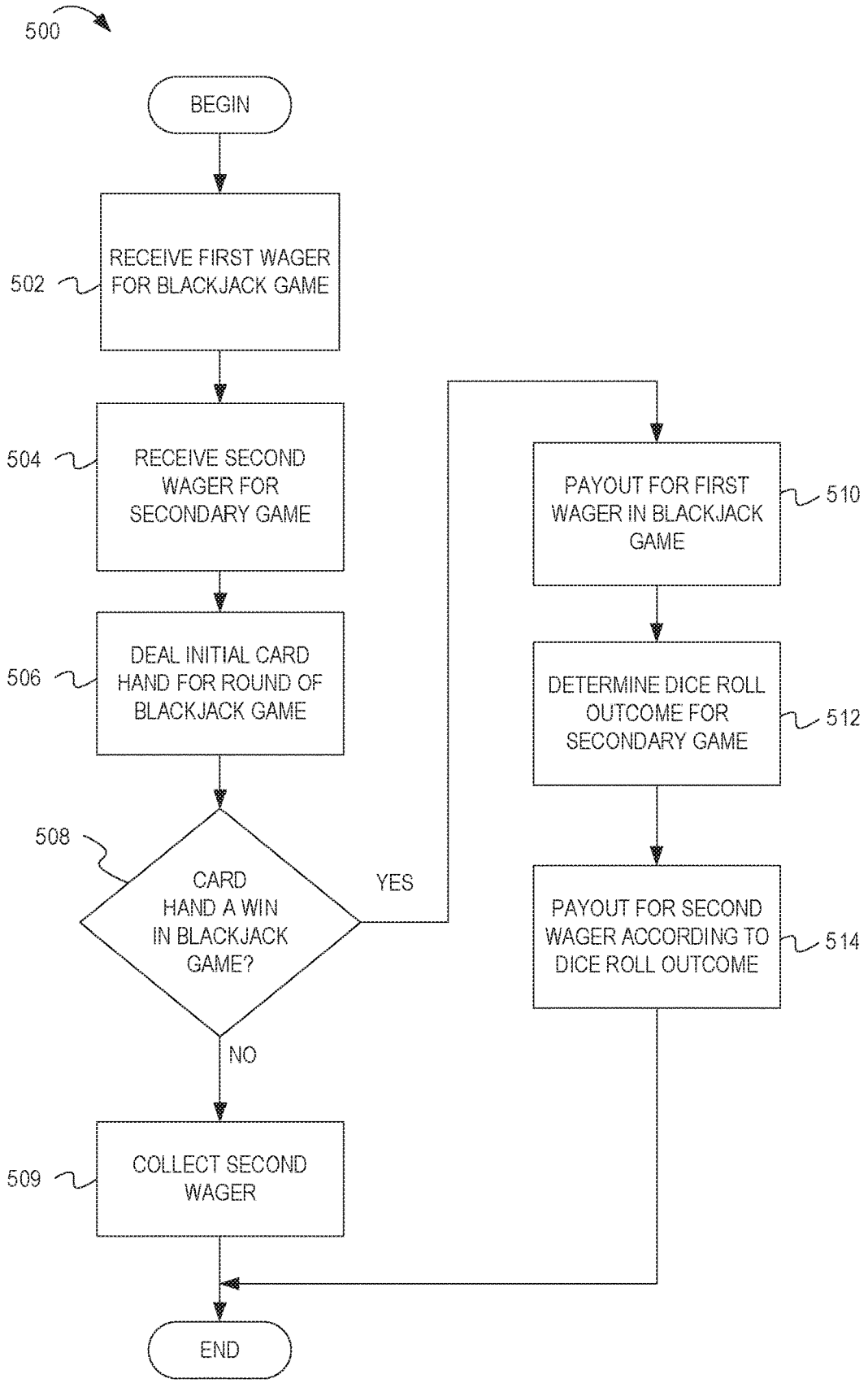
FIG. 5 is a flowchart illustrating administering a blackjack game with dice, according to an embodiment.

FIG. 5 is a flow chart ("flow") 500 illustrating administering a blackjack game with dice, according to some embodiments.

In FIG. 5, the flow 500 begins at processing block 502 with a dealer receiving a first wager for a blackjack game. In some instances, the first wager is a main wager on the blackjack game. The first wager is received in a designated area on the game layout before a hand of cards is dealt to the player hand position for the blackjack game. In some embodiments, the first wager is received in the designated area as a physical form of money, such when a physical chip is received in a betting area on the play surface of a physical table. In some embodiments, one or more cameras capture images of chips placed in the betting areas. In some embodiments, a processing unit analyzes the images to determine a value of the chips placed on the physical table for the first wager. In other embodiments, the first wager is received electronically, such via wireless communication sent from a player's mobile device or from a player betting interface.

The flow 500 continues at processing block 504 with receiving a second wager in a second designated area of the play surface for participating in a secondary game. For instance, the secondary game may be a bonus game that incorporates a use of dice. In some instances, the second wager is mandatory, or in other words, required to be placed in addition to a main wager.

The flow 500 continues at processing block 506 with the dealer dealing an initial card hand to each player play area for the blackjack game. For instance, a dealer deals the initial two cards of the blackjack game to each player area occupied by a player that placed a first wager and a second wager in the designated wager area and the second designated wager area. The dealer also deals a dealer's hand to a dealer card area on the play surface. In some instances, with multiple players, the dealer deals each player their initial two cards to each separate player card area before attempting to resolve any main bets and before initiating play of the secondary game.

The flow 500 continues at processing block 508 with determining whether the card hand dealt to the player is a winning combination in the blackjack game. In some instances, play for the secondary game begins only when a specific outcome occurs in the blackjack game, such as a blackjack win outcome. According to game rules for blackjack game disclosed, one or more specific outcomes necessitates a dice roll. For instance, a dealer determines whether the initial two cards dealt to a player in the playing round is a blackjack. A blackjack includes a combination of two player cards, where one card has a value of "11" (e.g., a soft "Ace" card) and the other card has a value of "10" (e.g., a card having a rank of either a numerical "10," a "Jack," a "Queen" or a "King"). If, at processing block 508, the card hand is not a winning hand in the blackjack game, the flow 500 continues at processing block 509 with collecting the second wager from the second designated player wager area, such as by taking any chips from the second designated player wager area placed as the second wager and the dealer placing the collected chips in the dealer's chip rack on the gaming table. However, if, at processing block 508, the player card hand is a win in the blackjack game, then the flow 500 continues at processing block 510 with paying out the first wager. For instance, the dealer pays the player a payout for the first wager after a blackjack win according to payout rules for the blackjack game (e.g. pays 3:2 or 6:5 on the first wager).

The flow 500 continues at processing block 512 with determining a dice roll outcome for the secondary game. In some instances, special dice are rolled at the table by the player. In some embodiments, each of the dice is a six-sided die including at least two sides with special indicia and four sides that are blank (or that do not have special indicia). In contrast, conventional dice have six sides, each side bearing a different game symbol (1-6 pips). In some examples, each of the six sides has an equal chance of being on top when the die is rolled. A detailed example of special dice is described in FIG. 6 according to one embodiment.

In some instances, the dice are considered a controlled gaming device and, as such, player access to the dice may be restricted. For instance, the dealer can lock the dice in a secure area associated with the physical table. Some embodiments include features to minimize player access to the dice. In one example, a dealer can hand the dice to the player in a cup. The player may shake the dice in the cup then place the cup on the blackjack table. The dealer can expose the dice and announce an outcome. In some instances, a dealer may roll the dice on behalf of the player. In other instances, a projection device at the blackjack table may project a digital image of dice onto a surface of the table, while a processor unit determines whether the player's body motion indicates an intention to initiate the dice roll. For instance, the processor unit may receive recorded images of a player's position and movement at the blackjack table and analyze the images of the player to determine specific body motions performed by the player. If the processor unit detects a specific body motion of the player indicative of an intention to roll the dice (e.g., a player moves their hand as if shaking and/or throwing dice), then the processor unit can cause a projection device to project a digital image of the dice as if being physically moved. In other embodiments, a physical dice popper with a transparent upper surface or dome may be used to contain and pop the dice and prevent player and dealer access to the dice.

The flow 500 continues at processing block 514 with paying out the second wager according to the dice roll outcome. For instance, a dealer inspects the dice after the player has rolled them to determine an outcome of the dice roll (e.g., to determine the indicia, or lack of indicia, showing on the top of each die that comes to rest after the dice roll).

Figure 6:
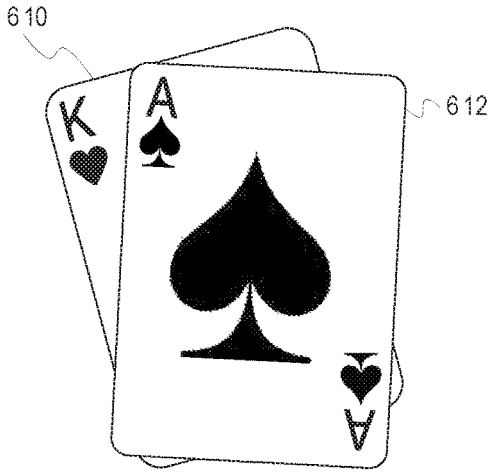
FIG. 6 is a drawing of a physical blackjack table for use in a casino, according to an embodiment.
Figure 6:
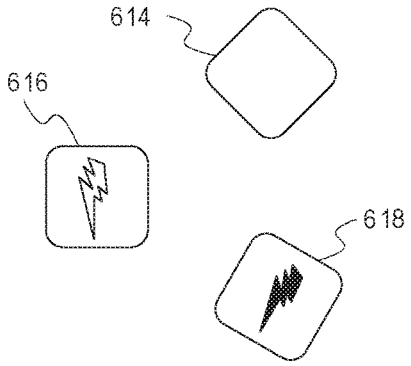
Figure 6:
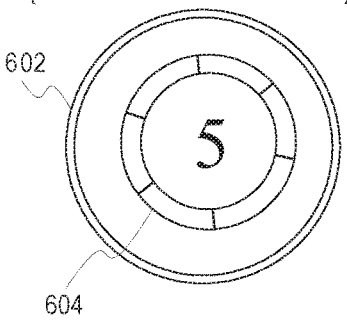
Figure 6:
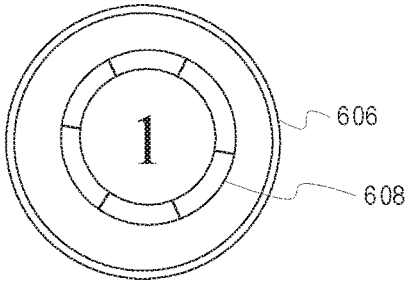

FIG. 6 is a drawing of a portion of a physical blackjack table for use in a casino, according to an embodiment. Illustrated in FIG. 6 is a physical table 600. The physical table 600 includes a first betting area 602 for a first player designated for placement of a first wager. In one instance, the first betting area 602 includes a graphic indicating a designated first wager receiving area printed onto a surface of the physical table 600. In other examples, an image of the graphic may be projected onto the physical table 600. The first betting area 602 may also including markings that present player instructions, help tips, or other information related to play of the blackjack game. For instance, the first betting area 602 presents the player instructions "Main Bet Here" to indicate that to place a wager on the blackjack game, at least one chip must first be received on the first betting area 602. In some instances, a minimum bet amount applies, such as $5. The first betting area 602 also presents the information "Blackjack Pays Out 3:2" which indicates that if the player gets a blackjack hand, the blackjack game will pay out on the first wager using 3:2 ratio (e.g., in the case of a win, the dealer would pay out $3 for any $2 wagered, plus the player would also receive the $2 wager back). For instance, a player places a first chip 604 (e.g., a $5 chip) in the first betting area 602. Receipt of the first chip 604 signifies a request to play a round of the blackjack game.

The physical table 600 also includes a second designated area for receiving a second mandatory wager, indicated as betting area 606. The second betting area 606 indicates that a second wager (referred to in FIG. 6 as a "Lightning Bet") is required to be placed on a secondary game (e.g., referred to in FIG. 6 as the "Lightning Blackjack" feature). In some instances, the dealer does not play out the main game until the second wager is placed. As illustrated in FIG. 6, a chip 608 is received in the second betting area 606 as the second wager. In some instances, a minimum bet amount applies, such as $1.

Still referring to FIG. 6, after the first wager and the second wager are received, an initial two-card hand is dealt to the designated player card area, such as by removing cards from a card handling device (see FIG. 7) and placing the cards in each participating player's playing area. In the example shown in FIG. 6, the initial two-card hand happens to be a blackjack (also referred to herein as a "natural 21") which includes both a 10-value card 610 (e.g., a King) and an 11-value card 612 (i.e., an Ace), which is a blackjack (also referred to as a "natural 21"). Thus, the player wins the first wager, and the dealer administers the game by paying the player the designated odds for having a blackjack. In the example shown in FIG. 6, a dealer would pay out $7.50 on the $5 main bet (according to the 3:2 payout ratio). The original $5.00 wager is also returned to the player. Further, because of the blackjack outcome of the two-card hand, a player is provided three dice (e.g., die 614, die 616, and die 618). In some embodiments, each die is a standard sized playing die having six sides of equivalent dimensions. Each die also includes four sides that are blank (as depicted on die 614), one side with first indicia (e.g., a white lightning bolt, as depicted on die 616), and one side with second indicia (e.g., a black lightning bolt). The white lightning bolt and the black lightning bolt are similar in shape, yet distinctly different in color. The player, dealer or a mechanical dice popper rolls the three dice. After the dice are rolled, the dealer determines the outcome on the three dice and administers the game by referring to a paytable 620 for the secondary game to calculate a payout for the second wager (e.g., to determine a payout for the "Lightning Bet"). Table IV illustrates an example of the paytable 620 as it pertains to the various outcomes possible from a roll of the three dice 614, 616 and 618.

TABLE IV

| Dice Roll Outcome | Paytable |
|---|---|
| 0 bolts | 9 to 1 |
| 1 bolt | 10 to 1 |
| 2 mixed color bolts | 20 to 1 |
| 2 same color bolts | 40 to 1 |
| 3 mixed color bolts | 100 to 1 |
| 3 same color bolts | 200 to 1 |

If the player does not hold a blackjack in the initial two-card hand, the second wager (the mandatory "Lightning Bet," or chip 608) is lost. If the player does have a blackjack, the player wins a payout on the first blackjack wager (on the main bet, or chip 604) and wins a second payout on the second wager (on the "Lightning Bet", or chip 608), the outcome being randomly determined by throwing a plurality of specialized dice.

In FIG. 6, the dice 614, 616, and 618 were rolled and came to rest in the configuration shown, with a top of die 614 being one of its four blank sides, a top of die 616 being its one side with the white lightning bolt, and a top of die 618 being its one side with the black lighting bolt. Thus, the dice roll outcome shows two bolts, but of different (e.g., "mixed") colors (e.g., one bolt is white and one is black). In other words, the outcome of the dice roll is "2 mixed color bolts" and, thus, according to paytable 620, the payout is "20 to 1" for the $1 Lightning Bet. The dealer would thus pay the player $20 and also return the $1.00 bet.

After the first wager and second wager are resolved for the player(s) who got a blackjack, if there are any other players at the table 600 who did not get a blackjack on their initial two-card hand, play resumes in the blackjack game for those additional players until the playing round is over. Because the additional players did not get the blackjack in the main game, they lose their respective second bets (e.g., they would lose their Lightning Bets after being dealt their initial two cards). However, they may still be eligible to win a payout on the first wager on the blackjack game based on further play in the playing round.

Figure 7:
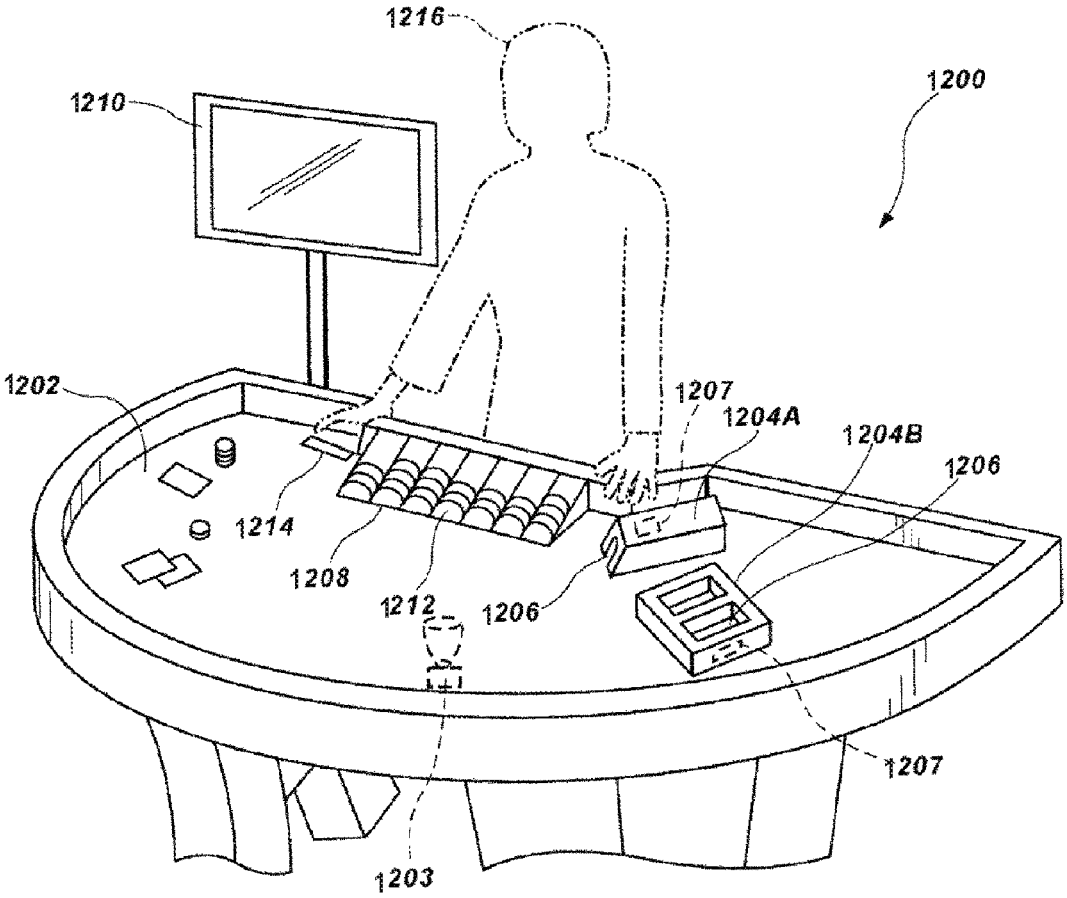
FIG. 7 is a perspective view of a gaming table configured for implementation of embodiments of wagering games in accordance with this disclosure.

FIG. 7 is a perspective view of an embodiment of a gaming table 1200 (which may be configured as the table 300 of FIG. 3 or the table 600 of FIG. 6) for implementing wagering games in accordance with this disclosure. The gaming table 1200 may be a physical article of furniture around which participants in the wagering game may stand or sit and on which the physical objects used for administering and otherwise participating in the wagering game may be supported, positioned, moved, transferred, and otherwise manipulated. For example, the gaming table 1200 may include a gaming surface 1202 (e.g., a table surface) on which the physical objects used in administering the wagering game may be located. The gaming surface 1202 may be, for example, a felt fabric covering a hard surface of the table, and a design, conventionally referred to as a "layout," specific to the game being administered may be physically printed on the gaming surface 1202. As another example, the gaming surface 1202 may be a surface of a transparent or translucent material (e.g., glass or plexiglass) onto which a projector 1203, which may be located, for example, above or below the gaming surface 1202, may illuminate a layout specific to the wagering game being administered. In such an example, the specific layout projected onto the gaming surface 1202 may be changeable, enabling the gaming table 1200 to be used to administer different variations of wagering games within the scope of this disclosure or other wagering games. Additional details of illustrative gaming surfaces and projectors are disclosed in U.S. patent application Ser. No. 13/919,849, filed Jun. 17, 2013, and titled "ELECTRONIC GAMING DISPLAYS, GAMING TABLES INCLUDING ELECTRONIC GAMING DISPLAYS AND RELATED ASSEMBLIES, SYSTEMS AND METHODS," the disclosure of which is incorporated herein in its entirety by this reference. In either example, the gaming surface 1202 may include, for example, designated areas for player positions; areas in which one or more of player cards, dealer cards, or community cards may be dealt; areas in which wagers may be accepted; areas in which wagers may be grouped into pots; and areas in which rules, pay tables, and other instructions related to the wagering game may be displayed. As a specific, nonlimiting example, the gaming surface 1202 may be configured as any table surface described herein.

In some embodiments, the gaming table 1200 may include a display 1210 separate from the gaming surface 1202. The display 1210 may be configured to face players, prospective players, and spectators and may display, for example, information randomly selected by a shuffler device and also displayed on a display of the shuffler device; rules; pay tables; real-time game status, such as wagers accepted and cards dealt; historical game information, such as amounts won, amounts wagered, percentage of hands won, and notable hands achieved; the commercial game name, the casino name, advertising and other instructions and information related to the wagering game. The display 1210 may be a physically fixed display, such as an edge lit sign, in some embodiments. In other embodiments, the display 1210 may change automatically in response to a stimulus (e.g., may be an electronic video monitor).

The gaming table 1200 may include particular machines and apparatuses configured to facilitate the administration of the wagering game. For example, the gaming table 1200 may include one or more card-handling devices 1204A, 1204B. The card-handling device 1204A may be, for example, a shoe from which physical cards 1206 from one or more decks of intermixed playing cards may be withdrawn, one at a time. Such a card-handling device 1204A may include, for example, a housing in which cards 1206 are located, an opening from which cards 1206 are removed, and a card-presenting mechanism (e.g., a moving weight on a ramp configured to push a stack of cards down the ramp) configured to continually present new cards 1206 for withdrawal from the shoe. Additional details of an illustrative card-handling device 1204A configured as a shoe are found in U.S. Patent App. Pub. No. 2010/0038849, published Feb. 18, 2010, and titled "INTELLIGENT AUTOMATIC SHOE AND CARTRIDGE," the disclosure of which is incorporated herein in its entirety by this reference.

In some embodiments in which the card-handling device 1204A is used, the card-handling device 1204A may include a random number generator 151 and the display 152, in addition to or rather than such features being included in a shuffler device. In addition to the card-handling device 1204A, the card-handling device 1204B may be included. The card-handling device 1204B may be, for example, a shuffler configured to select information (using a random number generator), to display the selected information on a display of the shuffler, to reorder (either randomly or pseudo-randomly) physical playing cards 1206 from one or more decks of playing cards, and to present randomized cards 1206 for use in the wagering game. Such a card-handling device 1204B may include, for example, a housing, a shuffling mechanism configured to shuffle cards, and card inputs and outputs (e.g., trays). Additional details of an illustrative card-handling device 1204B configured as a shuffler are found in U.S. Pat. No. 8,579,289, issued Dec. 6, 2011, to Rynda et al., the disclosure of which is incorporated herein in its entirety by this reference. This patent describes a shuffler that is marketed under the commercial name MD3 by Bally Gaming, Inc., the assignee of the present patent application. Shufflers such as the devices disclosed in the '289 patent may include card recognition capability and forms a randomly ordered set of cards within the shuffler. The card-handling device 1204 may also be, for example, a combination shuffler and shoe in which the output for the shuffler is a shoe. See for example Blaha et al. U.S. Patent Publication No. US20180243642A, the disclosure which is hereby incorporated by reference in its entirety, which describes a continuous card shuffler marketed under the name Shuffle Star by Bally Gaming, Inc., the assignee of the present invention.

In some embodiments, the card-handling device 1204 may be configured and programmed to administer at least a portion of a wagering game being played utilizing the card-handling device 1204. For example, the card-handling device 1204 may be programmed and configured to randomize a set of cards and deliver cards individually for use according to game rules and player and or dealer game play elections. More specifically, the card-handling device 1204 may be programmed and configured to, for example, randomize a set of six complete decks of cards including one or more standard 52-card decks of playing cards and, optionally, any specialty cards (e.g., a cut card, bonus cards, wild cards, or other specialty cards). In some embodiments, the card-handling device 1204 may present individual cards, one at a time, for withdrawal from the card-handling device 1204. In other embodiments, the card-handling device 1204 may present an entire shuffled block of cards that are transferred manually or automatically into a card dispensing shoe 1204. In some such embodiments, the card-handling device 1204 may accept dealer input, such as, for example, a number of replacement cards for discarded cards, a number of hit cards to add, or a number of partial hands to be completed. In other embodiments, the device may accept a dealer input from a menu of game options indicating a game selection, which will select programming to cause the card-handling device 1204 to deliver the requisite number of cards to the game according to game rules, player decisions and dealer decisions In still other embodiments, the card-handling device 1204 may present the complete set of randomized cards for manual or automatic withdrawal from a shuffler and then insertion into a shoe. As specific, non-limiting examples, the card-handling device 1204 may present a complete set of cards to be manually or automatically transferred into a card dispensing shoe, or may provide, a continuous supply of individual cards.

In another embodiment, the card handling device may be a batch shuffler such as the shuffler described by Grauzer U.S. Pat. No. 6,588,750, issued Jul. 8, 2003 which shows a device for randomizing a set of cards using a gripping, lifting, and insertion sequence. The disclosure of each of the foregoing documents is incorporated herein in its entirety by this reference.

In some embodiments, the card-handling device 1204 may employ a random number generator device to determine card order, such as, for example, a final card order or an order of insertion of cards into a compartment configured to form a packet of cards. The compartments may be sequentially numbered, and a random number assigned to each compartment number prior to delivery of the first card. In other embodiments, the random number generator may select a location in the stack of cards to separate the stack into two sub-stacks, creating an insertion point within the stack at a random location. The next card may be inserted into the insertion point. In yet other embodiments, the random number generator may randomly select a location in a stack to randomly remove cards by activating an ejector.

Regardless of whether the random number generator (or generators) is hardware or software, it may be used to implement specific game administrations methods of the present disclosure.

The card-handling device 1204 may simply be supported on the gaming surface 1202 in some embodiments. In other embodiments, the card-handling device 1204 may be mounted into the gaming table 1202 such that the card-handling device 1204 is not manually removable from the gaming table 1202 without the use of tools. In some embodiments, the deck or decks of playing cards used may be standard, 52-card decks. In other embodiments, the deck or decks used may include cards, such as, for example, jokers, wild cards, bonus cards, etc. The shuffler may also be configured to handle and dispense security cards, such as cut cards.

In some embodiments, the card-handling device 1204 may include an electronic display 1207 for displaying information related to the wagering game being administered. The electronic display 1207 may display a menu of game options, the name of the game selected, the number of cards per hand to be dispensed, acceptable amounts for other wagers (e.g., maximums and minimums), numbers of cards to be dealt to recipients, locations of particular recipients for particular cards, winning and losing wagers, pay tables, winning hands, losing hands, and payout amounts. In other embodiments, information related to the wagering game may be displayed on another electronic display, such as, for example, the display 1210 described previously.

The type of card-handling device 1204 employed to administer embodiments of the disclosed wagering game, as well as the type of card deck employed and the number of decks, may be specific to the game to be implemented. Cards used in games of this disclosure may be, for example, standard playing cards from one or more decks, each deck having cards of four suits (clubs, hearts, diamonds, and spades) and of rankings ace, king, queen, jack, and ten through two in descending order. As a more specific example, six, seven, or eight standard decks of such cards may be intermixed. Typically, six or eight decks of 52 standard playing cards each may be intermixed and formed into a set to administer a blackjack or blackjack variant game. A suitable device employing random number generation for card management and randomization is marketed under the name MD3® by Bally Gaming, Inc. of Las Vegas, Nev. Aspects of this device are described in U.S. Pat. No. 8,579,289, issued Nov. 12, 2013, to Rynda et al., and the shuffling mechanism is fully described in U.S. Pat. No. 7,677,565, issued Mar. 16, 2010, to Grauzer et al., the disclosure of each of which is incorporated herein in its entirety by this reference. After shuffling, the randomized set may be transferred into another portion of the card-handling device 1204B or another card-handling device 1204A altogether, such as a mechanized shoe capable of reading card rank and suit. More specifically, the shoe disclosed in, for example, U.S. Pat. No. 8,511,684, issued Aug. 20, 2013, to Grauzer et al., the disclosure of which is incorporated herein in its entirety by this reference, may be used to automatically dispense one or more cards at a time from the randomized set to a game.

The gaming table 1200 may include one or more chip racks 1208 configured to facilitate accepting wagers, transferring lost wagers to the house, and exchanging monetary value for wagering elements 1212 (e.g., chips). For example, the chip rack 1208 may include a series of token support rows, each of which may support tokens of a different type (e.g., color and denomination). In some embodiments, the chip rack 1208 may be configured to automatically present a selected number of chips using a chip-cutting-and-delivery mechanism. Additional details of an illustrative chip rack 1208 and chip-cutting-and-delivery mechanism are found in U.S. Pat. No. 7,934,980, issued May 3, 2011, to Blaha et al., the disclosure of which is incorporated herein in its entirety by this reference. In some embodiments, the gaming table 1200 may include a drop box 1214 for money that is accepted in exchange for wagering elements or chips 1212. The drop box 1214 may be, for example, a secure container (e.g., a safe or lockbox) having a one-way opening into which money may be inserted and a secure, lockable opening from which money may be retrieved. Such drop boxes 1214 are known in the art, and may be incorporated directly into the gaming table 1200 and may, in some embodiments, have a removable container for the retrieval of money in a separate, secure location.

When administering a wagering game in accordance with embodiments of this disclosure, a dealer 1216 may receive money (e.g., cash) from a player in exchange for wagering elements 1212. The dealer 1216 may deposit the money in the drop box 1214 and transfer physical wagering elements 1212 to the player. As part of the method of administering the game, the dealer 1216 may accept one or more initial wagers (e.g., the first blackjack and second lightning wagers) from the player, which may be reflected by the dealer 1216 permitting the player to place one or more wagering elements 1212 or other wagering tokens (e.g., cash) within designated areas (e.g., areas 602 and 606 in FIG. 6) on the gaming surface 1202 associated with the various wagers of the wagering game. Once initial wagers have been accepted, the dealer 1216 may remove physical cards 1206 from the card-handling device 1204 (e.g., individual cards, packets of cards, or the complete set of cards) in some embodiments. In other embodiments, the physical cards 1206 may be hand-pitched (i.e., the dealer 1216 may optionally shuffle the cards 1206 to randomize the set and may hand-deal cards 1206 from the randomized set of cards). The dealer 1216 may position cards 1206 within designated areas on the gaming surface 1202, which may designate the cards 1206 for use as individual player cards, community cards, or dealer cards in accordance with game rules. House rules may require the dealer to accept both the blackjack and lightning wagers before card distribution. House rules may alternatively allow the player to place only one wager (i.e., the second wager) during card distribution and after the initial wagers have been placed, or after card distribution but before all cards available for play are revealed.

In some embodiments, after dealing the cards 1206, and during play, according to the game rules, any additional wagers (e.g., the play wager) may be accepted, which may be reflected by the dealer 1216 permitting the player to place one or more wagering elements 1212 within the designated area (i.e., area 124) on the gaming surface 1202 associated with the play wager of the wagering game. The dealer 1216 may perform any additional card dealing according to the game rules. Finally, the dealer 1216 may resolve the wagers, award winning wagers to the players, which may be accomplished by giving wagering elements 1212 from the chip rack 1208 to the players, and transferring losing wagers to the house, which may be accomplished by moving wagering elements 1212 from the player designated wagering areas to the chip rack 1208.

Figure 8:
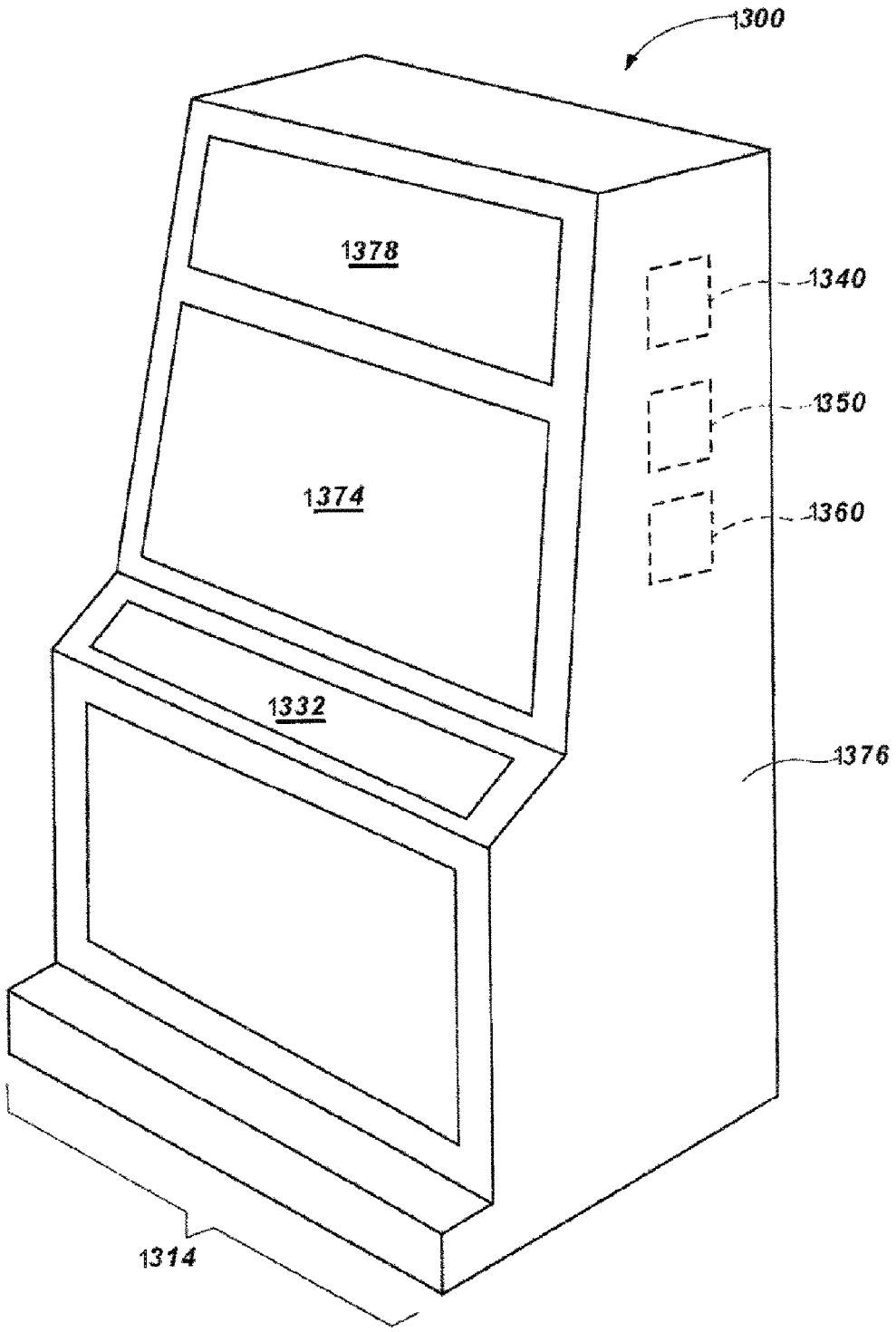
FIG. 8 is a perspective view of an individual electronic gaming device configured for implementation of embodiments of wagering games in accordance with this disclosure.

FIG. 8 is a perspective view of an individual electronic gaming device 1300 (e.g., an electronic gaming machine (EGM)) configured for implementing wagering games according to this disclosure. The individual electronic gaming device 1300 may include an individual player position 1314 including a player input area 1332 configured to enable a player to interact with the individual electronic gaming device 1300 through various input devices (e.g., buttons, levers, touchscreens). The player input area 1332 may further includes a cash- or ticket-in receptor, by which cash or a monetary-valued ticket may be fed, by the player, to the individual electronic gaming device 1300, which may then detect, in association with game-logic circuitry in the individual electronic gaming device 1300, the physical item (cash or ticket) associated with the monetary value and then establish a credit balance for the player. In other embodiments, the individual electronic gaming device 1300 detects a signal indicating an electronic wager was made. Wagers may then be received, and covered by the credit balance, upon the player using the player input area 1332 or elsewhere on the machine (such as through a touch screen). Won payouts and pushed or returned wagers may be reflected in the credit balance at the end of the round, the credit balance being increased to reflect won payouts and pushed or returned wagers and/or decreased to reflect lost wagers.

The individual electronic gaming device 1300 may further include, in the individual player position 1312, a ticket-out printer or monetary dispenser through which a payout from the credit balance may be distributed to the player upon receipt of a cashout instruction, input by the player using the player input area 1332.

The individual electronic gaming device 1300 may include a gaming screen 1374 configured to display indicia for interacting with the individual electronic gaming device 1300, such as through processing one or more programs stored in game-logic circuitry providing memory 1340 to implement the rules of game play at the individual electronic gaming device 1300. Accordingly, in some embodiments, game play may be accommodated without involving physical playing cards, chips or other wagering elements, and live personnel. The action may instead be simulated by a control processor 1350 operably coupled to the memory 1340 and interacting with and controlling the individual electronic gaming device 1300. For example, the processor may cause the display 1374 to display cards, including virtual player and virtual dealer cards for playing games of the present disclosure.

Although the individual electronic gaming device 1300 displayed in FIG. 8 has an outline of a traditional gaming cabinet, the individual electronic gaming device 1300 may be implemented in other ways, such as, for example, on a bartop gaming terminal, through client software downloaded to a portable device, such as a smart phone, tablet, or laptop computer. The individual electronic gaming device 1300 may also be a non-portable personal computer (e.g., a desktop or all-in-one computer) or other computing device. In some embodiments, client software is not downloaded but is native to the device or is otherwise delivered with the device when distributed. In such embodiments, the credit balance may be established by receiving payment via credit card or player's account information input into the system by the player. Cashouts of the credit balance may be allotted to a player's account or card.

A communication device 1360 may be included and operably coupled to the processor 1350 such that information related to operation of the individual electronic gaming device 1300, information related to the game play, or combinations thereof may be communicated between the individual electronic gaming device 1300 and other devices, such as a server, through a suitable communication medium, such, as, for example, wired networks, Wi-Fi networks, and cellular communication networks.

The gaming screen 1374 may be carried by a generally vertically extending cabinet 1376 of the individual electronic gaming device 1300. The individual electronic gaming device 1300 may further include banners to communicate rules of game play, instructions, game play advice or hints and the like, such as along a top portion 1378 of the cabinet 1376 of the individual electronic gaming device 1300. The individual electronic gaming device 1300 may further include additional decorative lights (not shown), and speakers (not shown) for transmitting and optionally receiving sounds during game play. Further detail of an example of an individual electronic gaming device 1300 (as well as other embodiments of tables and devices) is disclosed in U.S. patent application Ser. No. 13/963,165, filed Aug. 9, 2013, and titled "METHODS AND SYSTEMS FOR ELECTRONIC GAMING," the disclosure of which is incorporated herein in its entirety by this reference.

Some embodiments may be implemented at locations including a plurality of player stations. Such player stations may include an electronic display screen for display of game information (e.g., cards, wagers, and game instructions) and for accepting wagers and facilitating credit balance adjustments. Such player stations may, optionally, be integrated in a table format, may be distributed throughout a casino or other gaming site, or may include both grouped and distributed player stations.

Figure 9:
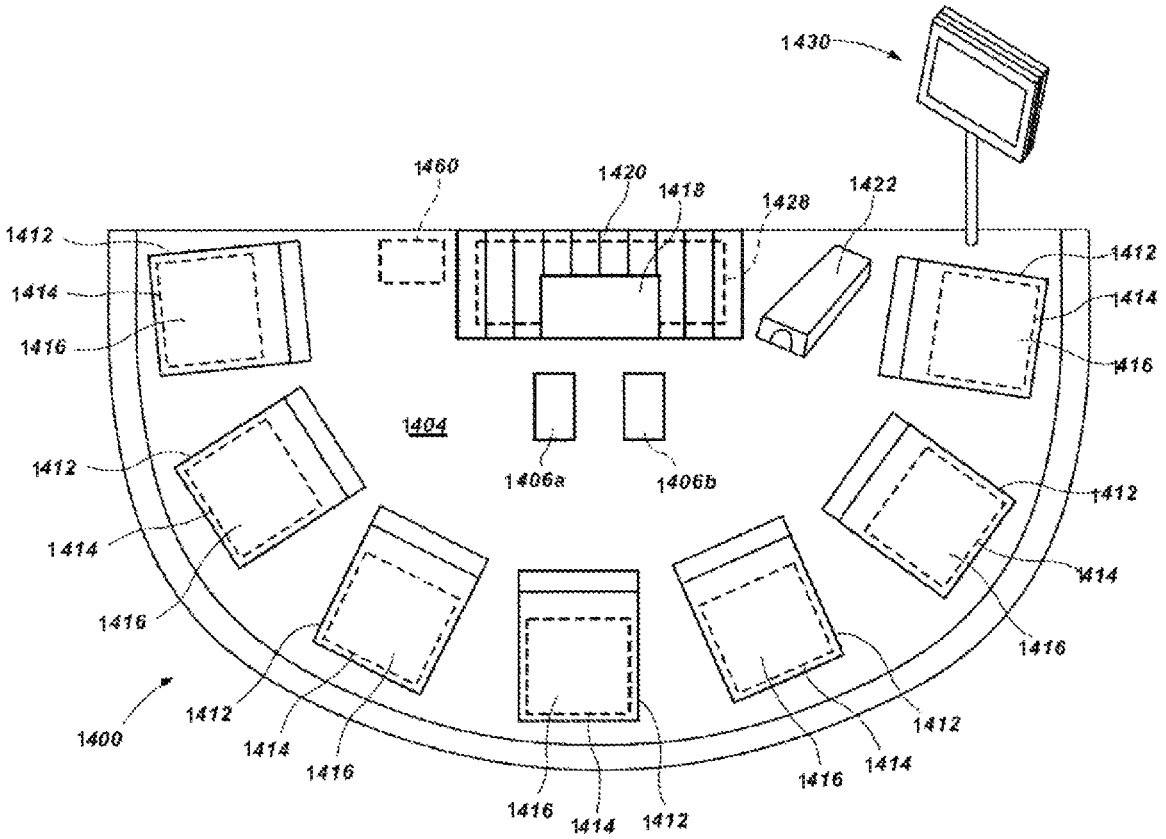
FIG. 9 is a top view of a table configured for implementation of embodiments of wagering games in accordance with this disclosure.

FIG. 9 is a top view of a suitable table 1400 configured for implementing wagering games according to this disclosure. The table 1400 may include a playing surface 1404. The table 1400 may include electronic player stations 1412. Each player station 1412 may include a player interface 1416, which may be used for displaying game information (e.g., graphics illustrating a player layout, game instructions, input options, wager information, game outcomes, etc.) and accepting player elections. The player interface 1416 may be a display screen in the form of a touch screen, which may be at least substantially flush with the playing surface 1404 in some embodiments. Each player interface 1416 may be operated by its own local game processor 1414 (shown in dashed lines), although, in some embodiments, a central game processor 1428 (shown in dashed lines) may be employed and may communicate directly with player interfaces 1416. In some embodiments, a combination of individual local game processors 1414 and the central game processor 1428 may be employed. Each of the processors 1414 and 1428 may be operably coupled to memory including one or more programs related to the rules of game play at the table 1400.

A communication device 1460 may be included and may be operably coupled to one or more of the local game processors 1414, the central game processor 1428, or combinations thereof, such that information related to operation of the table 1400, information related to the game play, or combinations thereof may be communicated between the table 1400 and other devices through a suitable communication medium, such as, for example, wired networks, Wi-Fi networks, and cellular communication networks.

The table 1400 may further include additional features, such as a dealer chip tray 1420, which may be used by the dealer to cash players in and out of the wagering game, whereas wagers and balance adjustments during game play may be performed using, for example, virtual chips (e.g., images or text representing wagers). For embodiments using physical cards 1406*a* and 1406*b*, the table 1400 may further include a card-handling device 1422 such as a card shoe configured to read and deliver cards that have already been randomized. For embodiments using virtual cards, the virtual cards may be displayed at the individual player interfaces 1416. Physical playing cards designated as "common cards" may be displayed in a common card area.

The table 1400 may further include a dealer interface 1418, which, like the player interfaces 1416, may include touch screen controls for receiving dealer inputs and assisting the dealer in administering the wagering game. The table 1400 may further include an upright display 1430 configured to display images that depict game information, pay tables, hand counts, historical win/loss information by player, and a wide variety of other information considered useful to the players. The upright display 1430 may be double sided to provide such information to players as well as to casino personnel.

Further detail of an example of a table and player displays is disclosed in U.S. Pat. No. 8,262,475, issued Sep. 11, 2012, and titled "CHIPLESS TABLE SPLIT SCREEN FEATURE," the disclosure of which is incorporated herein in its entirety by this reference. Although an embodiment is described showing individual discrete player stations, in some embodiments, the entire playing surface 1404 may be an electronic display that is logically partitioned to permit game play from a plurality of players for receiving inputs from, and displaying game information to, the players, the dealer, or both.

Figure 10:
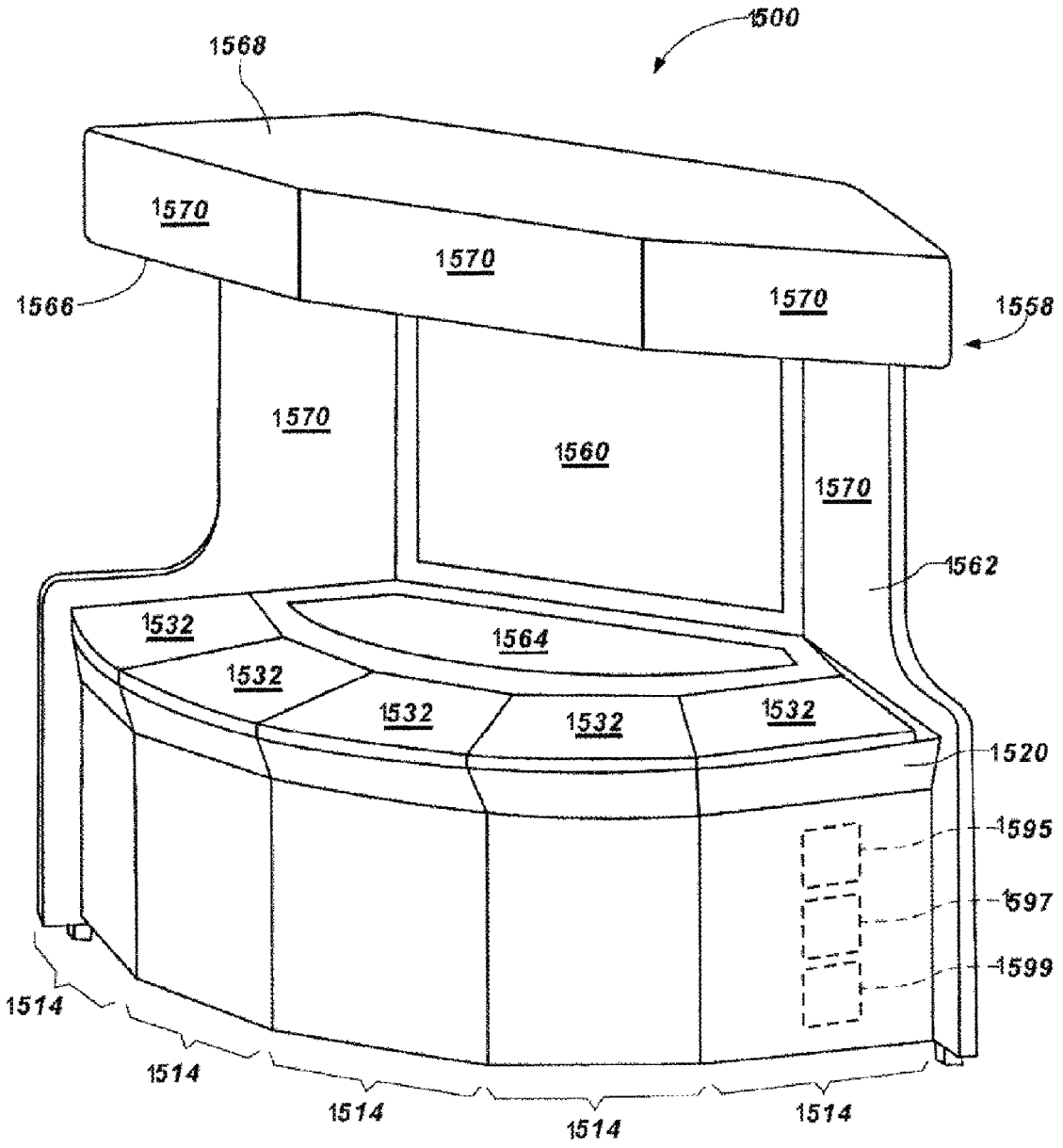
FIG. 10 is a perspective view of another embodiment of a table configured for implementation of embodiments of wagering games in accordance with this disclosure, wherein the implementation includes a virtual dealer.

FIG. 10 is a perspective view of another embodiment of a suitable electronic multi-player table 1500 configured for implementing wagering games according to the present disclosure utilizing a virtual dealer. The table 1500 may include player positions 1514 arranged in a bank about an arcuate edge 1520 of a video device 1558 that may comprise a card screen 1564 and a virtual dealer screen 1560. The dealer screen 1560 may display a video simulation of the dealer (i.e., a virtual dealer) for interacting with the video device 1558, such as through processing one or more stored programs stored in memory 1595 to implement the rules of game play at the video device 1558. The dealer screen 1560 may be carried by a generally vertically extending cabinet 1562 of the video device 1558. The substantially horizontal card screen 1564 may be configured to display at least one or more of the dealer's cards, any community cards, and each player's cards dealt by the virtual dealer on the dealer screen 1560.

Each of the player positions 1514 may include a player interface area 1532 configured for wagering and game play interactions with the video device 1558 and virtual dealer. Accordingly, game play may be accommodated without involving physical playing cards, poker chips, and live personnel. The action may instead be simulated by a control processor 1597 interacting with and controlling the video device 1558. The control processor 1597 may be programmed, by known techniques, to implement the rules of game play at the video device 1558. As such, the control processor 1597 may interact and communicate with display/input interfaces and data entry inputs for each player interface area 1532 of the video device 1558. Other embodiments of tables and gaming devices may include a control processor that may be similarly adapted to the specific configuration of its associated device.

A communication device 1599 may be included and operably coupled to the control processor 1597 such that information related to operation of the table 1500, information related to the game play, or combinations thereof may be communicated between the table 1500 and other devices, such as a central server, through a suitable communication medium, such, as, for example, wired networks, Wi-Fi networks, and cellular communication networks.

The video device 1558 may further include banners communicating rules of play and the like, which may be located along one or more walls 1570 of the cabinet 1562. The video device 1558 may further include additional decorative lights and speakers, which may be located on an underside surface 1566, for example, of a generally horizontally extending top 1568 of the cabinet 1562 of the video device 1558 generally extending toward the player positions 1514.

Further detail of an example of a table and player displays is disclosed in U.S. Pat. No. 8,272,958, issued Sep. 25, 2012, and titled "AUTOMATED MULTIPLAYER GAME TABLE WITH UNIQUE IMAGE FEED OF DEALER," the disclosure of which is incorporated herein in its entirety by this reference. Although an embodiment is described showing individual discrete player stations, in some embodiments, the entire playing surface (e.g., player interface areas 1532, card screen 1564, etc.) may be a unitary electronic display that is logically partitioned to permit game play from a plurality of players for receiving inputs from, and displaying game information to, the players, the dealer, or both.

Figure 11:
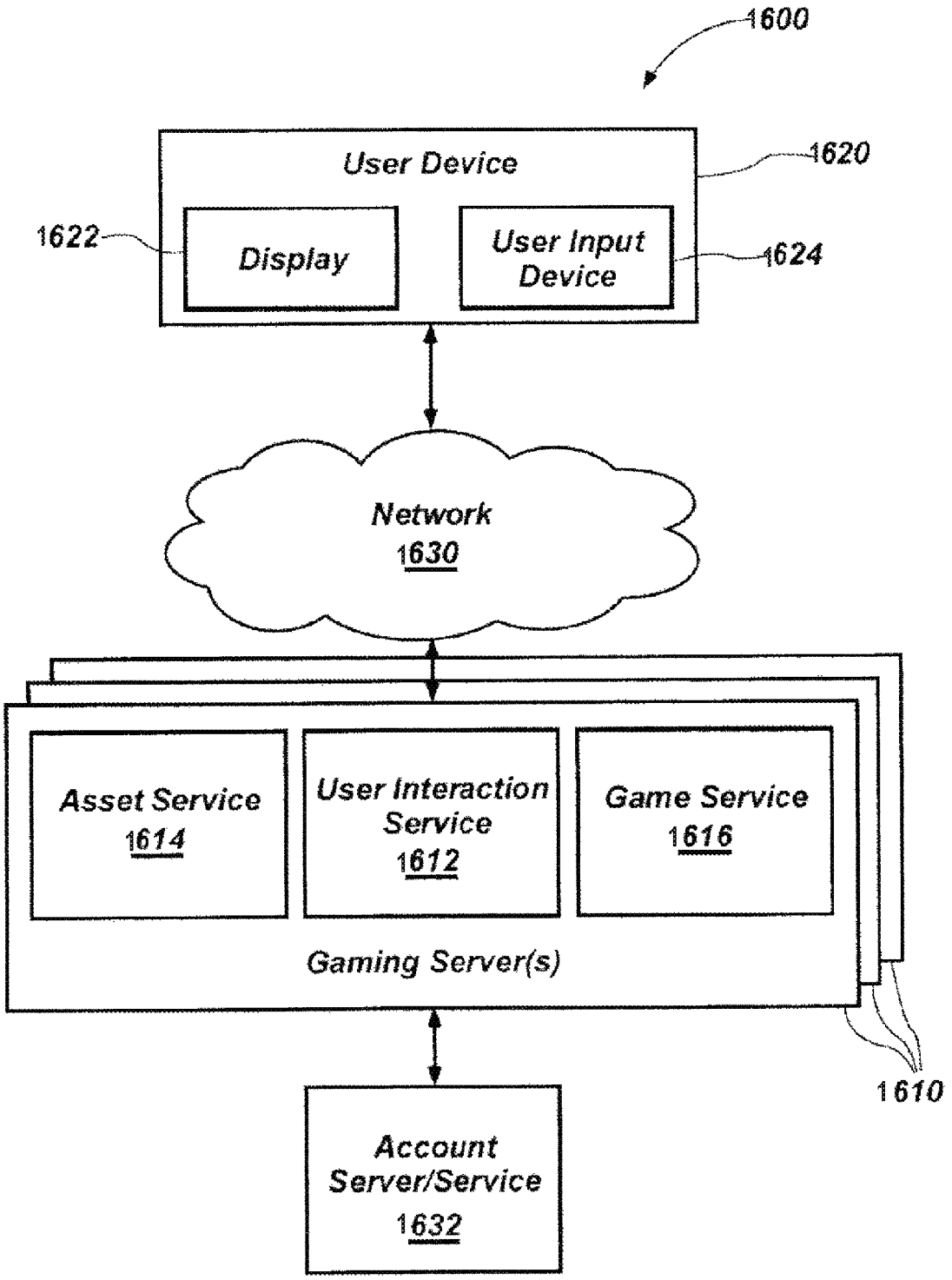
FIG. 11 is a schematic block diagram of a gaming system for implementing embodiments of wagering games in accordance with this disclosure.

In some embodiments, wagering games in accordance with this disclosure may be administered using a gaming system employing a client-server architecture (e.g., over the Internet, a local area network, etc.). FIG. 11 is a schematic block diagram of an illustrative gaming system 1600 for implementing wagering games according to this disclosure. The gaming system 1600 may enable end users to remotely access game content. Such game content may include, without limitation, various types of wagering games such as card games, dice games, big wheel games, roulette, scratch off games ("scratchers"), and any other wagering game where the game outcome is determined, in whole or in part, by one or more random events. This includes, but is not limited to, Class II and Class III games as defined under 25 U.S.C. § 2701 et seq. ("Indian Gaming Regulatory Act"). Such games may include banked and/or non-banked games.

The wagering games supported by the gaming system 1600 may be operated with real currency or with virtual credits or other virtual (e.g., electronic) value indicia. For example, the real currency option may be used with traditional casino and lottery-type wagering games in which money or other items of value are wagered and may be cashed out at the end of a game session. The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, time played in one session, or games played; or may be as simple as being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This feature may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The gaming system 1600 may enable players to buy additional game credits to allow the player to resume play. Objects of value may be awarded to play-for-fun players, which may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The gaming system 1600 may include a gaming platform to establish a portal for an end user to access a wagering game hosted by one or more gaming servers 1610 over a network 1630. In some embodiments, games are accessed through a user interaction service 1612. The gaming system 1600 enables players to interact with a user device 1620 through a user input device 1624 and a display 1622 and to communicate with one or more gaming servers 1610 using a network 1630 (e.g., the Internet). Typically, the user device is remote from the gaming server 1610 and the network is the word-wide web (i.e., the Internet).

In some embodiments, the gaming servers 1610 may be configured as a single server to administer wagering games in combination with the user device 1620. In other embodiments, the gaming servers 1610 may be configured as separate servers for performing separate, dedicated functions associated with administering wagering games. Accordingly, the following description also discusses "services" with the understanding that the various services may be performed by different servers or combinations of servers in different embodiments. As shown in FIG. 11, the gaming servers 1610 may include a user interaction service 1612, a game service 1616, and an asset service 1614. In some embodiments, one or more of the gaming servers 1610 may communicate with an account server 1632 performing an account service 1632. As explained more fully below, for some wagering type games, the account service 1632 may be separate and operated by a different entity than the gaming servers 1610; however, in some embodiments the account service 1632 may also be operated by one or more of the gaming servers 1610.

The user device 1620 may communicate with the user interaction service 1612 through the network 1630. The user interaction service 1612 may communicate with the game service 1616 and provide game information to the user device 1620. In some embodiments, the game service 1616 may also include a game engine. The game engine may, for example, access, interpret, and apply game rules. In some embodiments, a single user device 1620 communicates with a game provided by the game service 1616, while other embodiments may include a plurality of user devices 1620 configured to communicate and provide end users with access to the same game provided by the game service 1616. In addition, a plurality of end users may be permitted to access a single user interaction service 1612, or a plurality of user interaction services 1612, to access the game service 1616. The user interaction service 1612 may enable a user to create and access a user account and interact with game service 1616. The user interaction service 1612 may enable users to initiate new games, join existing games, and interface with games being played by the user.

The user interaction service 1612 may also provide a client for execution on the user device 1620 for accessing the gaming servers 1610. The client provided by the gaming servers 1610 for execution on the user device 1620 may be any of a variety of implementations depending on the user device 1620 and method of communication with the gaming servers 1610. In one embodiment, the user device 1620 may connect to the gaming servers 1610 using a web browser, and the client may execute within a browser window or frame of the web browser. In another embodiment, the client may be a stand-alone executable on the user device 1620.

For example, the client may comprise a relatively small amount of script (e.g., JAVASCRIPT®), also referred to as a "script driver," including scripting language that controls an interface of the client. The script driver may include simple function calls requesting information from the gaming servers 1610. In other words, the script driver stored in the client may merely include calls to functions that are externally defined by, and executed by, the gaming servers 1610. As a result, the client may be characterized as a "thin client." The client may simply send requests to the gaming servers 1610 rather than performing logic itself. The client may receive player inputs, and the player inputs may be passed to the gaming servers 1610 for processing and executing the wagering game. In some embodiments, this may involve providing specific graphical display information for the display 1622 as well as game outcomes.

As another example, the client may comprise an executable file rather than a script. The client may do more local processing than does a script driver, such as calculating where to show what game symbols upon receiving a game outcome from the game service 1616 through user interaction service 1612. In some embodiments, portions of an asset service 1614 may be loaded onto the client and may be used by the client in processing and updating graphical displays. Some form of data protection, such as end-to-end encryption, may be used when data is transported over the network 1630. The network 1630 may be any network, such as, for example, the Internet or a local area network.

The gaming servers 1610 may include an asset service 1614, which may host various media assets (e.g., text, audio, video, and image files) to send to the user device 1620 for presenting the various wagering games to the end user. In other words, the assets presented to the end user may be stored separately from the user device 1620. For example, the user device 1620 requests the assets appropriate for the game played by the user; as another example, especially relating to thin clients, just those assets that are needed for a particular display event will be sent by the gaming servers 1610, including as few as one asset. The user device 1620 may call a function defined at the user interaction service 1612 or asset service 1614, which may determine which assets are to be delivered to the user device 1620 as well as how the assets are to be presented by the user device 1620 to the end user. Different assets may correspond to the various user devices 1620 and their clients that may have access to the game service 1616 and to different variations of wagering games.

The gaming servers 1610 may include the game service 1616, which may be programmed to administer wagering games and determine game play outcomes to provide to the user interaction service 1612 for transmission to the user device 1620. For example, the game service 1616 may include game rules for one or more wagering games, such that the game service 1616 controls some or all of the game flow for a selected wagering game as well as the determined game outcomes. The game service 1616 may include pay tables and other game logic. The game service 1616 may perform random number generation for determining random game elements of the wagering game. In one embodiment, the game service 1616 may be separated from the user interaction service 1612 by a firewall or other method of preventing unauthorized access to the game service 1612 by the general members of the network 1630.

The user device 1620 may present a gaming interface to the player and communicate the user interaction from the user input device 1624 to the gaming servers 1610. The user device 1620 may be any electronic system capable of displaying gaming information, receiving user input, and communicating the user input to the gaming servers 1610. For example, the user device 1620 may be a desktop computer, a laptop, a tablet computer, a set-top box, a mobile device (e.g., a smartphone), a kiosk, a terminal, or another computing device. As a specific, nonlimiting example, the user device 1620 operating the client may be an interactive electronic gaming system 1300 (see FIG. 8), as described above. The client may be a specialized application or may be executed within a generalized application capable of interpreting instructions from an interactive gaming system, such as a web browser.

The client may interface with an end user through a web page or an application that runs on a device including, but not limited to, a smartphone, a tablet, or a general computer, or the client may be any other computer program configurable to access the gaming servers 1610. The client may be illustrated within a casino webpage (or other interface) indicating that the client is embedded into a webpage, which is supported by a web browser executing on the user device 1620.

In some embodiments, components of the gaming system 1600 may be operated by different entities. For example, the user device 1620 may be operated by a third party, such as a casino or an individual, that links to the gaming servers 1610, which may be operated, for example, by a wagering game service provider. Therefore, in some embodiments, the user device 1620 and client may be operated by a different administrator than the operator of the game service 1616. In other words, the user device 1620 may be part of a third-party system that does not administer or otherwise control the gaming servers 1610 or game service 1616. In other embodiments, the user interaction service 1612 and asset service 1614 may be operated by a third-party system. For example, a gaming entity (e.g., a casino) may operate the user interaction service 1612, user device 1620, or combination thereof to provide its customers access to game content managed by a different entity that may control the game service 1616, amongst other functionality. In still other embodiments, all functions may be operated by the same administrator. For example, a gaming entity (e.g., a casino) may elect to perform each of these functions in-house, such as providing access to the user device 1620, delivering the actual game content, and administering the gaming system 1600.

The gaming servers 1610 may communicate with one or more external account servers 1632 (also referred to herein as an account service 1632), optionally through another firewall. For example, the gaming servers 1610 may not directly accept wagers or issue payouts. That is, the gaming servers 1610 may facilitate online casino gaming but may not be part of self-contained online casino itself. Another entity (e.g., a casino or any account holder or financial system of record) may operate and maintain its external account service 1632 to accept bets and make payout distributions. The gaming servers 1610 may communicate with the account service 1632 to verify the existence of funds for wagering and to instruct the account service 1632 to execute debits and credits. As another example, the gaming servers 1610 may directly accept bets and make payout distributions, such as in the case where an administrator of the gaming servers 1610 operates as a casino.

Additional features may be supported by the gaming servers 1610, such as hacking and cheating detection, data storage and archival, metrics generation, messages generation, output formatting for different end user devices, as well as other features and operations. For example, the gaming servers 1610 may include additional features and configurations as described in U.S. patent application Ser. No. 13/353,194, filed Jan. 18, 2012, and U.S. patent application Ser. No. 13/609,031, filed Sep. 10, 2012, both applications titled "NETWORK GAMING ARCHITECTURE, GAMING SYSTEMS, AND RELATED METHODS," the disclosure of each of which is incorporated herein in its entirety by this reference.

Figure 12:
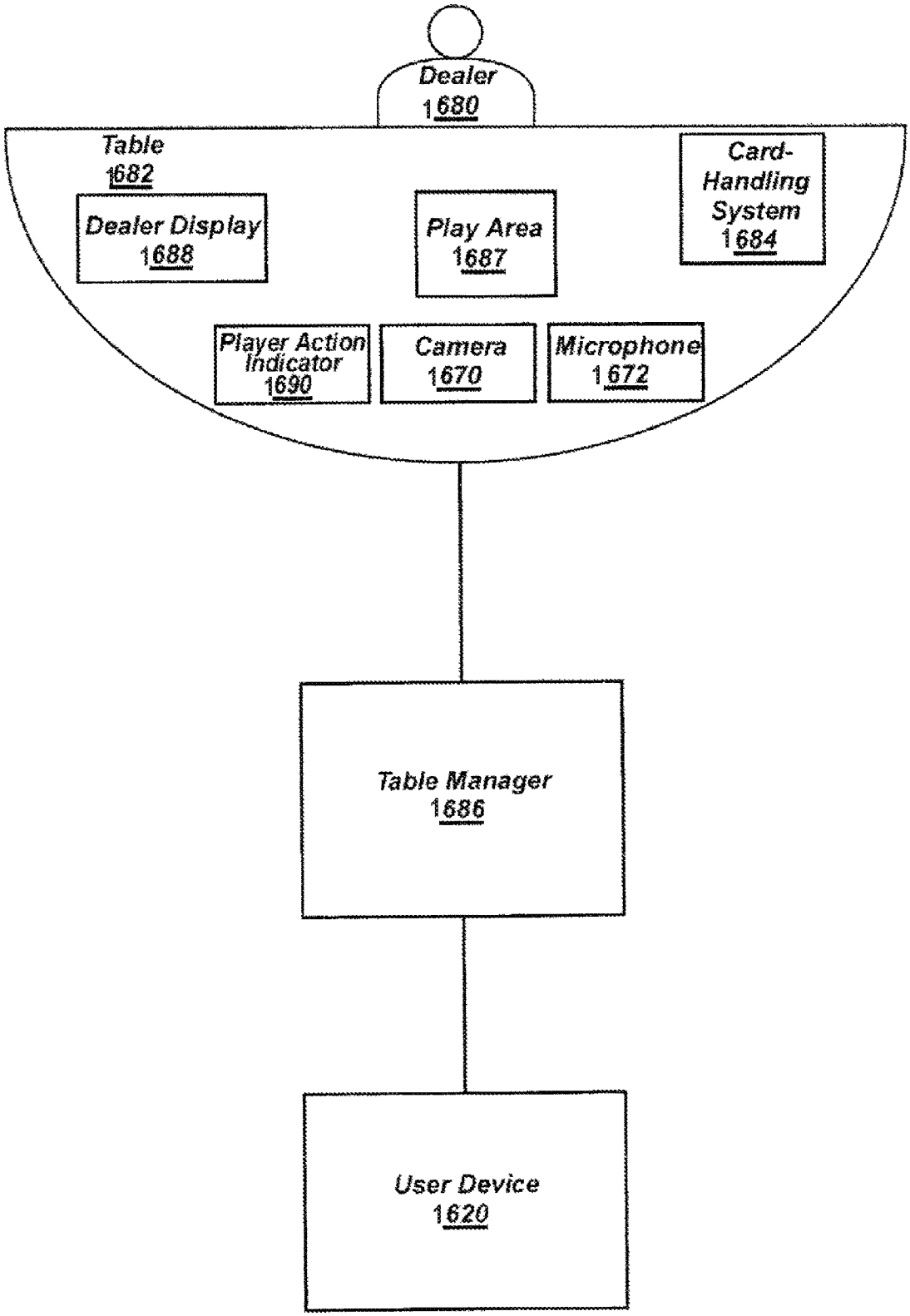
FIG. 12 is a schematic block diagram of a gaming system for implementing embodiments of wagering games including a live dealer feed.

FIG. 12 is a schematic block diagram of a table 1682 for implementing wagering games including a live dealer video feed. Features of the gaming system 1600 (see FIG. 11) described above in connection with FIG. 11 may be utilized in connection with this embodiment, except as further described. Rather than cards being determined by computerized random processes, physical cards (e.g., from a standard, 52-card deck of playing cards) may be dealt by a live dealer 1680 at a table 1682 from a card-handling system 1684 located in a studio or on a casino floor. A table manager

1686 may assist the dealer 1680 in facilitating play of the game by transmitting a live video feed of the dealer's actions to the user device 1620 and transmitting remote player elections to the dealer 1680. As described above, the table manager 1686 may act as or communicate with a gaming system 1600 (see FIG. 11) (e.g., acting as the gaming system 1600 (see FIG. 11) itself or as an intermediate client interposed between and operationally connected to the user device 1620 and the gaming system 1600 (see FIG. 11)) to provide gaming at the table 1682 to users of the gaming system 1600 (see FIG. 11). Thus, the table manager 1686 may communicate with the user device 1620 through a network 1630 (see FIG. 11), and may be a part of a larger online casino, or may be operated as a separate system facilitating game play. In various embodiments, each table 1682 may be managed by an individual table manager 1686 constituting a gaming device, which may receive and process information relating to that table. For simplicity of description, these functions are described as being performed by the table manager 1686, though certain functions may be performed by an intermediary gaming system 1600 (see FIG. 11), such as the one shown and described in connection with FIG. 11. In some embodiments, the gaming system 1600 (see FIG. 11) may match remotely located players to tables 1682 and facilitate transfer of information between user devices 1620 and tables 1682, such as wagering amounts and player option elections, without managing gameplay at individual tables. In other embodiments, functions of the table manager 1686 may be incorporated into a gaming system 1600 (see FIG. 11).

The table 1682 includes a camera 1670 and optionally a microphone 1672 to capture video and audio feeds relating to the table 1682. The camera 1670 may be trained on the live dealer 1680, play area 1687, and card-handling system 1684. As the game is administered by the live dealer 1680, the video feed captured by the camera 1670 may be shown to the player remotely using the user device 1620, and any audio captured by the microphone 1672 may be played to the player remotely using the user device 1620. In some embodiments, the user device 1620 may also include a camera, microphone, or both, which may also capture feeds to be shared with the dealer 1680 and other players. In some embodiments, the camera 1670 may be trained to capture images of the card faces, chips, and chip stacks on the surface of the gaming table. Known image extraction techniques may be used to obtain card count and card rank and suit information from the card images. An example of suitable image extraction software is disclosed in U.S. Pat. No. 7,901,285, issued Mar. 8, 2011, to Tran et al., the disclosure of which is incorporated in this disclosure in its entirety by this reference.

Card and wager data in some embodiments may be used by the table manager 1686 to determine game outcome. The data extracted from the camera 1670 may be used to confirm the card data obtained from the card-handling system 1684, to determine a player position that received a card, and for general security monitoring purposes, such as detecting player or dealer card switching, for example. Examples of card data include, for example, suit and rank information of a card, suit and rank information of each card in a hand, rank information of a hand, and rank information of every hand in a round of play.

The live video feed permits the dealer to show cards dealt by the card-handling system 1684 and play the game as though the player were at a gaming table, playing with other players in a live casino. In addition, the dealer can prompt a user by announcing a player's election is to be performed. In embodiments where a microphone 1672 is included, the dealer 1680 can verbally announce action or request an election by a player. In some embodiments, the user device 1620 also includes a camera or microphone, which also captures feeds to be shared with the dealer 1680 and other players.

The card-handling system 1684 may be as shown and described previously in connection with FIG. 7. The play area 1686 depicts player layouts for playing the game, such as shown in FIGS. 3 and 6. As determined by the rules of the game, the player at the user device 1620 may be presented options for responding to an event in the game using a client as described with reference to FIG. 11.

Player elections may be transmitted to the table manager 1686, which may display player elections to the dealer 1680 using a dealer display 1688 and player action indicator 1690 on the table 1682. For example, the dealer display 1688 may display information regarding where to deal the next card or which player position is responsible for the next action.

In some embodiments, the table manager 1686 may receive card information from the card-handling system 1684 to identify cards dealt by the card-handling system 1684. For example, the card-handling system 1684 may include a card reader to determine card information from the cards. The card information may include the rank and suit of each dealt card and hand information.

The table manager 1686 may apply game rules to the card information, along with the accepted player decisions, to determine gameplay events and wager results. Alternatively, the wager results may be determined by the dealer 1680 and input to the table manager 1686, which may be used to confirm automatically determined results by the gaming system.

Card and wager data in some embodiments may be used by the table manager 1686 to determine game outcome. The data extracted from the camera 1670 may be used to confirm the card data obtained from the card-handling system 1684, to determine a player position that received a card, and for general security monitoring purposes, such as detecting player or dealer card switching, for example.

The live video feed permits the dealer to show cards dealt by the card-handling system 1684 and play the game as though the player were at a live casino. In addition, the dealer can prompt a user by announcing a player's election is to be performed. In embodiments where a microphone 1672 is included, the dealer 1680 can verbally announce action or request an election by a player. In some embodiments, the user device 1620 also includes a camera or microphone, which also captures feeds to be shared with the dealer 1680 and other players.

Figure 13:
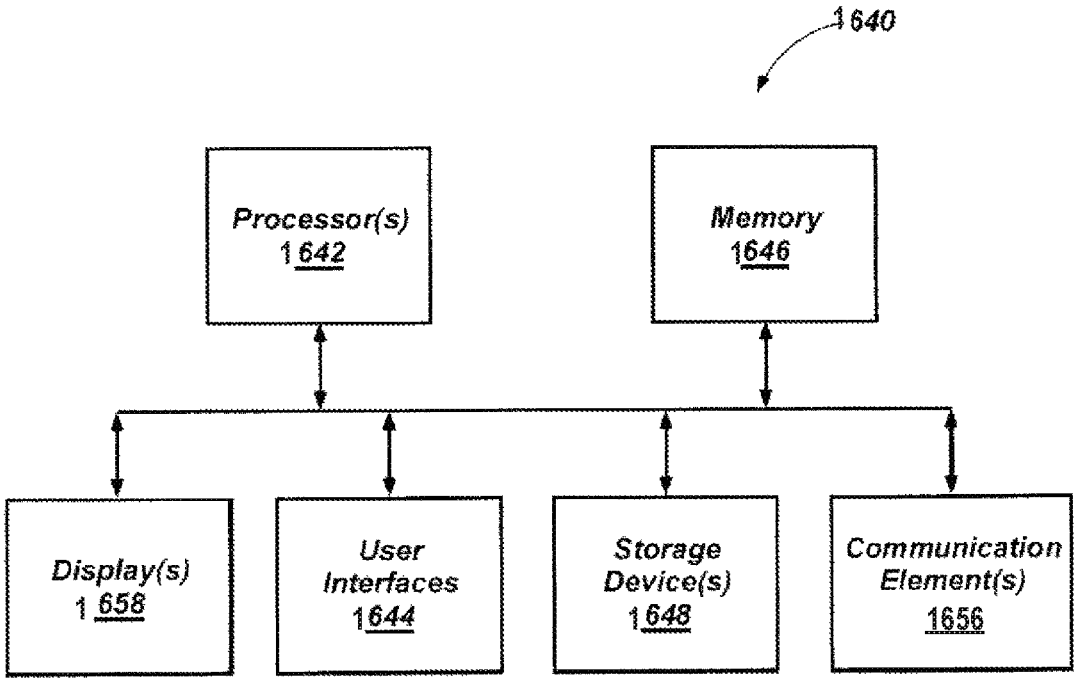
FIG. 13 is a block diagram of a computer for acting as a gaming system for implementing embodiments of wagering games in accordance with this disclosure.

FIG. 13 is a simplified block diagram showing elements of computing devices that may be used in systems and apparatuses of this disclosure. A computing system 1640 may be a user-type computer, a file server, a computer server, a notebook computer, a tablet, a handheld device, a mobile device, or other similar computer system for executing software. The computing system 1640 may be configured to execute software programs containing computing instructions and may include one or more processors 1642, memory 1646, one or more displays 1658, one or more user interface elements 1644, one or more communication elements 1656, and one or more storage devices 1648 (also referred to herein simply as storage 1648).

The processors 1642 may be configured to execute a wide variety of operating systems and applications including the computing instructions for administering wagering games of the present disclosure.

The processors 1642 may be configured as a general-purpose processor such as a microprocessor, but in the alternative, the general-purpose processor may be any processor, controller, microcontroller, or state machine suitable for carrying out processes of the present disclosure. The processor 1642 may also be implemented as a combination of computing devices, such as a combination of a DSP and a microprocessor, a plurality of microprocessors, one or more microprocessors in conjunction with a DSP core, or any other such configuration.

A general-purpose processor may be part of a general-purpose computer. However, when configured to execute instructions (e.g., software code) for carrying out embodiments of the present disclosure the general-purpose computer should be considered a special-purpose computer. Moreover, when configured according to embodiments of the present disclosure, such a special-purpose computer improves the function of a general-purpose computer because, absent the present disclosure, the general-purpose computer would not be able to carry out the processes of the present disclosure. The processes of the present disclosure, when carried out by the special-purpose computer, are processes that a human would not be able to perform in a reasonable amount of time due to the complexities of the data processing, decision making, communication, interactive nature, or combinations thereof for the present disclosure. The present disclosure also provides meaningful limitations in one or more particular technical environments that go beyond an abstract idea. For example, embodiments of the present disclosure provide improvements in the technical field related to the present disclosure.

The memory 1646 may be used to hold computing instructions, data, and other information for performing a wide variety of tasks including administering wagering games of the present disclosure. By way of example, and not limitation, the memory 1646 may include Synchronous Random Access Memory (SRAM), Dynamic RAM (DRAM), Read-Only Memory (ROM), Flash memory, and the like.

The display 1658 may be a wide variety of displays such as, for example, light-emitting diode displays, liquid crystal displays, cathode ray tubes, and the like. In addition, the display 1658 may be configured with a touch-screen feature for accepting user input as a user interface element 1644.

As nonlimiting examples, the user interface elements 1644 may include elements such as displays, keyboards, push-buttons, mice, joysticks, haptic devices, microphones, speakers, cameras, and touchscreens.

As nonlimiting examples, the communication elements 1656 may be configured for communicating with other devices or communication networks. As nonlimiting examples, the communication elements 1656 may include elements for communicating on wired and wireless communication media, such as for example, serial ports, parallel ports, Ethernet connections, universal serial bus (USB) connections, IEEE 1394 ("firewire") connections, THUNDERBOLT™ connections, BLUETOOTH® wireless networks, ZigBee wireless networks, 802.11 type wireless networks, cellular telephone/data networks, fiber optic networks and other suitable communication interfaces and protocols.

The storage 1648 may be used for storing relatively large amounts of nonvolatile information for use in the computing system 1640 and may be configured as one or more storage devices. By way of example and not limitation, these storage devices may include computer-readable media (CRM). This CRM may include, but is not limited to, magnetic and optical storage devices such as disk drives, magnetic tape, CDs (compact discs), DVDs (digital versatile discs or digital video discs), and semiconductor devices such as RAM, DRAM, ROM, EPROM, Flash memory, and other equivalent storage devices.

A person of ordinary skill in the art will recognize that the computing system 1640 may be configured in many different ways with different types of interconnecting buses between the various elements. Moreover, the various elements may be subdivided physically, functionally, or a combination thereof. As one nonlimiting example, the memory 1646 may be divided into cache memory, graphics memory, and main memory. Each of these memories may communicate directly or indirectly with the one or more processors 1642 on separate buses, partially combined buses, or a common bus.

As a specific, nonlimiting example, various methods and features of the present disclosure may be implemented in a mobile, remote, or mobile and remote environment over one or more of Internet, cellular communication (e.g., Broadband), near field communication networks and other communication networks referred to collectively herein as an iGaming environment. The iGaming environment may be accessed through social media environments such as FACEBOOK® and the like. DragonPlay Ltd, acquired by Bally Technologies Inc., provides an example of a platform to provide games to user devices, such as cellular telephones and other devices utilizing ANDROID®, iPHONE® and FACEBOOK® platforms. Where permitted by jurisdiction, the iGaming environment can include pay-to-play (P2P) gaming where a player, from their device, can make value based wagers and receive value based awards. Where P2P is not permitted the features can be expressed as entertainment only gaming where players wager virtual credits having no value or risk no wager whatsoever such as playing a promotion game or feature.

Figure 14:
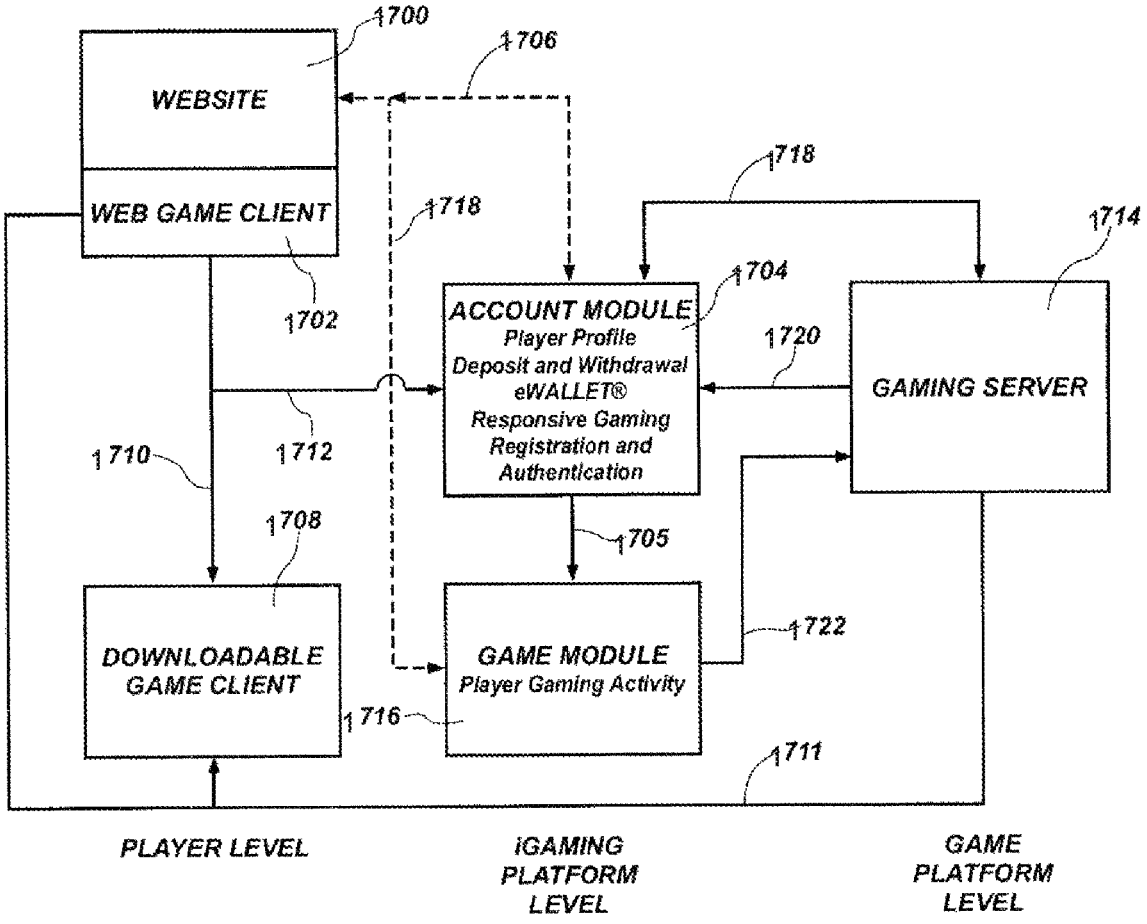
FIG. 14 illustrates an embodiment of data flows between various applications/services for supporting the game, feature or utility of the present disclosure for mobile/interactive gaming.

FIG. 14 illustrates an illustrative embodiment of information flows in an iGaming environment. At a player level, the player or user accesses a site hosting the activity such as a website 1700. The website 1700 may functionally provide a web game client 1702. The web game client 1702 may be, for example, represented by a game client 1708 downloadable at information flow 1710, which may process applets transmitted from a gaming server 1714 at information flow 1711 for rendering and processing game play at a player's remote device. Where the game is a P2P game, the gaming server 1714 may process value-based wagers (e.g., money wagers) and randomly generate an outcome for rendition at the player's device. In some embodiments, the web game client 1702 may access a local memory store to drive the graphic display at the player's device. In other embodiments, all or a portion of the game graphics may be streamed to the player's device with the web game client 1702 enabling player interaction and display of game features and outcomes at the player's device.

The website 1700 may access a player-centric, iGaming-platform-level account module 1704 at information flow 1706 for the player to establish and confirm credentials for play and, where permitted, access an account (e.g., an eWallet) for wagering. The account module 1704 may include or access data related to the player's profile (e.g., player-centric information desired to be retained and tracked by the host), the player's electronic account, deposit, and withdrawal records, registration and authentication information, such as username and password, name and address information, date of birth, a copy of a government issued identification document, such as a driver's license or passport, and biometric identification criteria, such as fingerprint or facial recognition data, and a responsible gaming module containing information, such as self-imposed or jurisdictionally imposed gaming restraints, such as loss limits, daily limits and duration limits. The account module 1704 may also contain and enforce geo-location limits, such as geographic areas where the player may play P2P games, user device IP address confirmation, and the like.

The account module 1704 communicates at information flow 1705 with a game module 1716 to complete log-ins, registrations, and other activities. The game module 1716 may also store or access a player's gaming history, such as player tracking and loyalty club account information. The game module 1716 may provide static web pages to the player's device from the game module 1716 through information flow 1718, whereas, as stated above, the live game content may be provided from the gaming server 1714 to the web game client through information flow 1711.

The gaming server 1714 may be configured to provide interaction between the game and the player, such as receiving wager information, game selection, inter-game player selections or choices to play a game to its conclusion, and the random selection of game outcomes and graphics packages, which, alone or in conjunction with the downloadable game client 1708/web game client 1702 and game module 1716, provide for the display of game graphics and player interactive interfaces. At information flow 1718, player account and log-in information may be provided to the gaming server 1714 from the account module 1704 to enable gaming. Information flow 1720 provides wager/credit information between the account module 1704 and gaming server 1714 for the play of the game and may display credits and eWallet availability. Information flow 1722 may provide player tracking information for the gaming server 1714 for tracking the player's play. The tracking of play may be used for purposes of providing loyalty rewards to a player, determining preferences, and the like.

All or portions of the features of FIG. 14 may be supported by servers and databases located remotely from a player's mobile device and may be hosted or sponsored by regulated gaming entity for P2P gaming or, where P2P is not permitted, for entertainment only play.

In some embodiments, wagering games may be administered in an at least partially player-pooled format, with payouts on pooled wagers being paid from a pot to players and losses on wagers being collected into the pot and eventually distributed to one or more players. Such player-pooled embodiments may include a player-pooled progressive embodiment, in which a pot is eventually distributed when a predetermined progressive-winning hand combination or composition is dealt. Player-pooled embodiments may also include a dividend refund embodiment, in which at least a portion of the pot is eventually distributed in the form of a refund distributed, e.g., pro-rata, to the players who contributed to the pot.

In some player-pooled embodiments, the game administrator may not obtain profits from chance-based events occurring in the wagering games that result in lost wagers. Instead, lost wagers may be redistributed back to the players. To profit from the wagering game, the game administrator may retain a commission, such as, for example, a player entrance fee or a rake taken on wagers, such that the amount obtained by the game administrator in exchange for hosting the wagering game is limited to the commission and is not based on the chance events occurring in the wagering game itself. The game administrator may also charge a rent of flat fee to participate.

It is noted that the methods described herein can be played with any number of standard decks of 52 cards (e.g., 1 deck to 10 decks). A standard deck is a collection of cards comprising an Ace, two, three, four, five, six, seven, eight, nine, ten, jack, queen, king, for each of four suits (comprising spades, diamonds, clubs, hearts) totaling 52 cards. Cards can be shuffled or a continuous shuffling machine (CSM) can be used. A standard deck of 52 cards can be used, as well as other kinds of decks, such as Spanish decks, decks with wild cards, etc. The operations described herein can be performed in any sensible order. Furthermore, numerous different variants of house rules can be applied.

Note that in the embodiments played using computers (a processor/processing unit), "virtual deck(s)" of cards are used instead of physical decks. A virtual deck is an electronic data structure used to represent a physical deck of cards which uses electronic representations for each respective card in the deck. In some embodiments, a virtual card is presented (e.g., displayed on an electronic output device using computer graphics, projected onto a surface of a physical table using a video projector, etc.) and is presented to mimic a real life image of that card.

Methods described herein can also be played on a physical table using physical cards and physical chips used to place wagers. Such physical chips can be directly redeemable for cash. When a player wins (dealer loses) the player's wager, the dealer will pay that player a respective payout amount. When a player loses (dealer wins) the player's wager, the dealer will take (collect) that wager from the player and typically place those chips in the dealer's chip rack. All rules, embodiments, features, etc. of a game being played can be communicated to the player (e.g., verbally or on a written rule card) before the game begins.

Initial cash deposits can be made into the electronic gaming machine which converts cash into electronic credits. Wagers can be placed in the form of electronic credits, which can be cashed out for real coins or a ticket (e.g., ticket-in-ticket-out) which can be redeemed at a casino cashier or kiosk for real cash and/or coins.

Any component of any embodiment described herein may include hardware, software, or any combination thereof Further, the operations described herein can be performed in any sensible order. Any operations not required for proper operation can be optional. Further, all methods described herein can also be stored as instructions on a computer readable storage medium, which instructions are operable by a computer processor. All variations and features described herein can be combined with any other features described herein without limitation. All features in all documents incorporated by reference herein can be combined with any feature(s) described herein, and also with all other features in all other documents incorporated by reference, without limitation.

Features of various embodiments of the inventive subject matter described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments which are defined only by the appended claims. Further, since numerous modifications and changes may readily occur to those skilled in the art, it is not desired to limit the inventive subject matter to the exact construction and operation illustrated and described, and accordingly all suitable modifications and equivalents may be resorted to, falling within the scope of the inventive subject matter.

What is claimed is:

1. A method of administering a blackjack game comprising:

receiving at least one wager in a designated player wager area on a gaming surface associated with the blackjack game, wherein the at least one wager is associated with at least one tangible gaming chip, and wherein the blackjack game is associated with a physical gaming table with a play surface, a set of specialized physical dice associated with a secondary game, an electronic processor, and at least one deck of physical cards;

dealing, after receiving the at least one wager, at least one hand from the at least one deck for the blackjack game;

determining, in response to analysis of the at least one hand by the electronic processor, that an outcome of the at least one hand necessitates a dice roll of the set of specialized physical dice associated with the secondary game;

determining, in response to analysis of the dice roll by the electronic processor, a payout value on the at least one wager based on an outcome of the dice roll, wherein each die in the set of specialized physical dice has at least one blank side and at least one side with indicia, wherein, for the outcome of the dice roll, the at least one side with the indicia signifies a multiplier for the payout value and the least one blank side signifies a push when the outcome of the dice roll shows all blank sides; and resolving the at least one wager according to the payout value.

2. The method of claim 1, wherein prior to the determining that the outcome of the at least one hand necessitates the dice roll, a first paytable applies to the at least one wager, and wherein the determining the payout value on the at least one wager comprises using a second paytable different from the first paytable.

3. The method of claim 1, wherein the set of specialized physical dice consists of three, six-sided dice, wherein each die in the set of specialized physical dice comprises four blank sides, one side with a first type of the indicia, and one side with a second type of the indicia different from the first type.

4. The method of claim 3, wherein the first type of the indicia comprises a symbol having a first color, and wherein the second type of the indicia comprises the symbol having a second color different from the first color.

5. The method of claim 4, wherein a paytable for the secondary game comprises a set of payout odds for dice roll outcomes according to at least a number of instances of the symbol, a number of instances of the first color, a number of instances of the second color, and a number of instances of a blank side.

6. The method of claim 1, wherein the determining that the outcome of the at least one hand necessitates the dice roll comprises determining that an initial two-card hand, associated with a player, is a player blackjack win outcome.

7. The method of claim 6 further comprising:

receiving an additional wager associated with the blackjack game; and after determining that the initial two-card hand is a blackjack win outcome, resolving the additional wager according to a first paytable associated with the blackjack game, wherein the determining the payout value on the at least one wager comprises using a second paytable associated with the secondary game, wherein the second paytable is different from the first paytable.

8. The method of claim 1, wherein the set of specialized physical dice consists of four, six-sided dice, wherein each die in the set of specialized physical dice includes five blank sides and one side with the indicia.

9. The method of claim 1, wherein the dealing the least one hand for the blackjack game comprises dealing the at least one hand from a shuffler device.

10. A gaming apparatus comprising:

a set of specialized dice; and a physical table having a layout with one or more designated player wager areas on a gaming surface of the physical table, wherein each of the one or more designated player wager areas is configured to receive at least one tangible gaming chip representing at least one wager on a blackjack game, wherein said gaming apparatus is configured to perform operations to receive the at least one wager at one of the one or more designated player wager areas, deal, after receiving the at least one wager, at least one hand from at least one deck of physical cards, determine that an outcome of the at least one hand, in the blackjack game, necessitates a dice roll of the set of specialized dice, wherein each die in the set of specialized dice has at least one blank side and at least one side with indicia, wherein, for an outcome of the dice roll, and the least one blank side signifies a push when the outcome shows all blank sides, cause the dice roll, determine a payout value on the at least one wager based on an outcome of the dice roll, and resolve the at least one wager according to the payout value.

11. The gaming apparatus of claim 10, wherein prior to occurrence of the outcome of the at least one hand, a first paytable applies to the at least one wager, and wherein after the occurrence of the outcome of the at least one hand, the payout value is determined using a second paytable different from the first paytable.

12. The gaming apparatus of claim 10, wherein the set of specialized dice consists of three, six-sided dice, wherein each die in the set of specialized dice comprises four blank sides, one side with a first type of the indicia, and one side with a second type of the indicia different from the first type.

13. The gaming apparatus of claim 12, wherein the first type of the indicia comprises a symbol having a first color, and wherein the second type of the indicia comprises the symbol having a second color different from the first color.

14. The gaming apparatus of claim 13, wherein a paytable for the outcome of the dice roll comprises a set of payout odds for dice roll outcomes according to at least a number of instances of the symbol, a number of instances of the first color, a number of instances of the second color, and a number of instances of a blank side.

15. The gaming apparatus of claim 10, wherein determination that the outcome of the at least one hand necessitates the dice roll comprises determination that an initial two-card hand, associated with a player, is a player blackjack win outcome.

16. The gaming apparatus of claim 15, said operations further to receive an additional wager associated with the blackjack game; and after determination that the initial two-card hand is a blackjack win outcome, resolve the additional wager according to a first paytable associated with the blackjack game, wherein determination of the payout value on the at least one wager comprises using a second paytable associated with a secondary game event, wherein the second paytable is different from the first paytable.

17. The gaming apparatus of claim 10, wherein the set of specialized dice consists of four, six-sided dice, wherein each die in the set of specialized dice includes five blank sides and the at least one side with the indicia.

18. The gaming apparatus of claim 10 further comprising a card-handling device, wherein the at least one hand is dealt from the card-handling device.

19. The gaming apparatus of claim 10, wherein the at least one side with the indicia signifies a multiplier for the payout value.

* * * * *